US008573295B2

(12) United States Patent
Johnson et al.

(10) Patent No.: US 8,573,295 B2
(45) Date of Patent: Nov. 5, 2013

(54) PLUG AND METHOD OF UNPLUGGING A SEAT

(75) Inventors: Michael H. Johnson, Katy, TX (US); Zhiyue Xu, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 263 days.

(21) Appl. No.: 12/947,048

(22) Filed: Nov. 16, 2010

(65) Prior Publication Data

US 2012/0118583 A1 May 17, 2012

(51) Int. Cl.
*E21B 33/12* (2006.01)
*E21B 29/02* (2006.01)

(52) U.S. Cl.
USPC ..... 166/193; 166/376

(58) Field of Classification Search
USPC ..... 166/300, 376, 193, 153; 156/247, 248, 156/701–719; 277/331, 316; 428/576, 559
See application file for complete search history.

(56) References Cited

U.S. PATENT DOCUMENTS

| | | | | |
|---|---|---|---|---|
| 2,238,895 | A | | 4/1941 | Gage |
| 2,261,292 | A | | 11/1941 | Salnikov |
| 2,983,634 | A | | 5/1961 | Budininkas et al. |
| 3,106,959 | A | | 10/1963 | Huitt et al. |
| 3,152,009 | A | | 10/1964 | DeLong |
| 3,326,291 | A | | 6/1967 | Zandmer et al. |
| 3,390,724 | A | | 7/1968 | Caldwell |
| 3,465,181 | A | | 9/1969 | Colby et al. |
| 3,513,230 | A | | 5/1970 | Rhees et al. |
| 3,637,446 | A | | 1/1972 | Elliott et al. |
| 3,645,331 | A | | 2/1972 | Maurer et al. |
| 3,768,563 | A | * | 10/1973 | Blount ..... 166/291 |
| 3,775,823 | A | | 12/1973 | Adolph et al. |
| 3,894,850 | A | | 7/1975 | Kovalchuk et al. |
| 4,010,583 | A | | 3/1977 | Highberg |
| 4,039,717 | A | | 8/1977 | Titus |
| 4,157,732 | A | | 6/1979 | Fonner |
| 4,248,307 | A | | 2/1981 | Silberman et al. |
| 4,372,384 | A | | 2/1983 | Kinney |
| 4,373,584 | A | | 2/1983 | Silberman et al. |
| 4,374,543 | A | | 2/1983 | Richardson |
| 4,384,616 | A | | 5/1983 | Dellinger |
| 4,399,871 | A | | 8/1983 | Adkins et al. |
| 4,422,508 | A | | 12/1983 | Rutledge, Jr. et al. |
| 4,452,311 | A | | 6/1984 | Speegle et al. |
| 4,498,543 | A | | 2/1985 | Pye et al. |

(Continued)

FOREIGN PATENT DOCUMENTS

| | | | |
|---|---|---|---|
| CA | 2783241 | A1 | 6/2011 |
| EP | 1798301 | A1 | 8/2006 |

(Continued)

OTHER PUBLICATIONS

N. Carrejo et al., "Improving Flow Assurance in Multi-Zone Fracturing Treatments in Hydrocarbon Reservoirs with High Strength Corrodible Tripping Balls"; Society of Petroleum Engineers; SPE Paper No. 151613; Apr. 16, 2012; 6 pages.

(Continued)

*Primary Examiner* — Daniel P Stephenson
(74) *Attorney, Agent, or Firm* — Cantor Colburn LLP

(57) ABSTRACT

A method of unplugging a seat, including dissolving at least a surface of a plug seated against the seat, and unseating the plug from the seat.

20 Claims, 5 Drawing Sheets

(56) References Cited

U.S. PATENT DOCUMENTS 4,499,048 A 2/1985 Hanejko
4,499,049 A 2/1985 Hanejko
4,534,414 A 8/1985 Pringle
4,539,175 A 9/1985 Lichti et al.
4,640,354 A 2/1987 Boisson
4,664,962 A 5/1987 DesMarais, Jr.
4,673,549 A 6/1987 Ecer
4,674,572 A 6/1987 Gallus
4,678,037 A 7/1987 Smith
4,681,133 A 7/1987 Weston
4,688,641 A 8/1987 Knieriemen
4,693,863 A 9/1987 Del Corso et al.
4,703,807 A 11/1987 Weston
4,706,753 A 11/1987 Ohkochi et al.
4,708,202 A 11/1987 Sukup et al.
4,708,208 A 11/1987 Halbardier
4,709,761 A 12/1987 Setterberg, Jr.
4,714,116 A 12/1987 Brunner
4,716,964 A 1/1988 Erbstoesser et al.
4,721,159 A 1/1988 Ohkochi et al.
4,738,599 A 4/1988 Shilling
4,741,973 A 5/1988 Condit et al.
4,768,588 A 9/1988 Kupsa
4,784,226 A 11/1988 Wyatt
4,805,699 A 2/1989 Halbardier
4,817,725 A 4/1989 Jenkins
4,834,184 A 5/1989 Streich et al.
H635 H 6/1989 Johnson et al.
4,850,432 A 7/1989 Porter et al.
4,853,056 A 8/1989 Hoffman
4,869,324 A 9/1989 Holder
4,869,325 A 9/1989 Halbardier
4,889,187 A 12/1989 Terrell et al.
4,890,675 A 1/1990 Dew
4,909,320 A 3/1990 Hebert et al.
4,929,415 A 5/1990 Okazaki
4,932,474 A 6/1990 Schroeder, Jr. et al.
4,944,351 A 7/1990 Eriksen et al.
4,949,788 A 8/1990 Szarka et al.
4,952,902 A 8/1990 Kawaguchi et al.
4,975,412 A 12/1990 Okazaki et al.
4,977,958 A 12/1990 Miller
4,981,177 A 1/1991 Carmody et al.
4,986,361 A 1/1991 Mueller et al.
5,006,044 A 4/1991 Walker, Sr. et al.
5,010,955 A 4/1991 Springer
5,036,921 A 8/1991 Pittard et al.
5,048,611 A 9/1991 Cochran
5,049,165 A 9/1991 Tselesin
5,061,323 A 10/1991 DeLuccia
5,063,775 A 11/1991 Walker, Sr. et al.
5,074,361 A 12/1991 Brisco et al.
5,084,088 A 1/1992 Okazaki
5,090,480 A 2/1992 Pittard et al.
5,095,988 A 3/1992 Bode
5,103,911 A 4/1992 Heijnen
5,117,915 A 6/1992 Mueller et al.
5,161,614 A 11/1992 Wu et al.
5,178,216 A 1/1993 Giroux et al.
5,181,571 A 1/1993 Mueller et al.
5,188,182 A 2/1993 Echols, III et al.
5,188,183 A 2/1993 Hopmann et al.
5,222,867 A 6/1993 Walker, Sr. et al.
5,226,483 A 7/1993 Williamson, Jr.
5,228,518 A 7/1993 Wilson et al.
5,234,055 A 8/1993 Cornette
5,252,365 A 10/1993 White
5,253,714 A 10/1993 Davis et al.
5,271,468 A 12/1993 Streich et al.
5,282,509 A 2/1994 Schurr, III
5,292,478 A 3/1994 Scorey
5,293,940 A 3/1994 Hromas et al.
5,309,874 A 5/1994 Willermet et al.
5,310,000 A 5/1994 Arterbury et al.
5,380,473 A 1/1995 Bogue et al.
5,392,860 A 2/1995 Ross
5,394,941 A 3/1995 Venditto et al.
5,398,754 A 3/1995 Dinhoble
5,407,011 A 4/1995 Layton
5,411,082 A 5/1995 Kennedy
5,417,285 A 5/1995 Van Buskirk et al.
5,425,424 A 6/1995 Reinhardt et al.
5,427,177 A 6/1995 Jordan, Jr. et al.
5,435,392 A 7/1995 Kennedy
5,439,051 A 8/1995 Kennedy et al.
5,454,430 A 10/1995 Kennedy et al.
5,456,317 A 10/1995 Hood, III et al.
5,456,327 A 10/1995 Denton et al.
5,464,062 A 11/1995 Blizzard, Jr.
5,472,048 A 12/1995 Kennedy et al.
5,474,131 A 12/1995 Jordan, Jr. et al.
5,477,923 A 12/1995 Jordan, Jr. et al.
5,479,986 A * 1/1996 Gano et al. ..... 166/292
5,526,880 A 6/1996 Jordan, Jr. et al.
5,526,881 A 6/1996 Martin et al.
5,529,746 A 6/1996 Knoss et al.
5,533,573 A 7/1996 Jordan, Jr. et al.
5,536,485 A 7/1996 Kume et al.
5,558,153 A 9/1996 Holcombe et al.
5,607,017 A 3/1997 Owens et al.
5,623,993 A 4/1997 Van Buskirk et al.
5,623,994 A 4/1997 Robinson
5,636,691 A 6/1997 Hendrickson et al.
5,641,023 A 6/1997 Ross et al.
5,647,444 A 7/1997 Williams
5,665,289 A 9/1997 Chung et al.
5,677,372 A 10/1997 Yamamoto et al.
5,707,214 A 1/1998 Schmidt
5,709,269 A 1/1998 Head
5,720,344 A 2/1998 Newman
5,765,639 A 6/1998 Muth
5,772,735 A 6/1998 Sehgal et al.
5,782,305 A 7/1998 Hicks
5,797,454 A 8/1998 Hipp
5,826,652 A 10/1998 Tapp
5,826,661 A 10/1998 Parker et al.
5,829,520 A 11/1998 Johnson
5,836,396 A 11/1998 Norman
5,857,521 A 1/1999 Ross et al.
5,881,816 A 3/1999 Wright
5,934,372 A 8/1999 Muth
5,941,309 A * 8/1999 Appleton ..... 166/317
5,960,881 A 10/1999 Allamon et al.
5,985,466 A 11/1999 Atarashi et al.
5,990,051 A 11/1999 Ischy et al.
5,992,452 A 11/1999 Nelson, II
5,992,520 A 11/1999 Schultz et al.
6,007,314 A 12/1999 Nelson, II
6,024,915 A 2/2000 Kume et al.
6,047,773 A 4/2000 Zeltmann et al.
6,050,340 A 4/2000 Scott
6,069,313 A 5/2000 Kay
6,076,600 A 6/2000 Vick, Jr. et al.
6,079,496 A 6/2000 Hirth
6,085,837 A 7/2000 Massinon et al.
6,095,247 A 8/2000 Streich et al.
6,119,783 A 9/2000 Parker et al.
6,142,237 A 11/2000 Christmas et al.
6,161,622 A 12/2000 Robb et al.
6,167,970 B1 1/2001 Stout et al.
6,173,779 B1 1/2001 Smith
6,189,616 B1 2/2001 Gano et al.
6,189,618 B1 * 2/2001 Beeman et al. ..... 166/312
6,213,202 B1 4/2001 Read, Jr.
6,220,350 B1 4/2001 Brothers et al.
6,228,904 B1 5/2001 Yadav et al.
6,237,688 B1 5/2001 Burleson et al.
6,238,280 B1 5/2001 Ritt et al.
6,241,021 B1 6/2001 Bowling
6,250,392 B1 6/2001 Muth
6,261,432 B1 7/2001 Huber et al.
6,273,187 B1 8/2001 Voisin, Jr. et al.
6,276,452 B1 8/2001 Davis et al.
6,276,457 B1 8/2001 Moffatt et al.

(56) References Cited

U.S. PATENT DOCUMENTS 6,279,656 B1 8/2001 Sinclair et al.
6,287,445 B1 9/2001 Lashmore et al.
6,302,205 B1 10/2001 Ryll
6,315,041 B1 11/2001 Carlisle et al.
6,315,050 B2 11/2001 Vaynshteyn et al.
6,325,148 B1 12/2001 Trahan et al.
6,328,110 B1 12/2001 Joubert
6,341,653 B1 1/2002 Firmaniuk et al.
6,341,747 B1 1/2002 Schmidt et al.
6,349,766 B1 2/2002 Bussear et al.
6,354,379 B2 3/2002 Miszewski et al.
6,371,206 B1 4/2002 Mills
6,382,244 B2 5/2002 Vann
6,390,195 B1 5/2002 Nguyen et al.
6,390,200 B1 5/2002 Allamon et al.
6,394,185 B1 5/2002 Constien
6,397,950 B1 6/2002 Streich et al.
6,403,210 B1 6/2002 Stuivinga et al.
6,408,946 B1 6/2002 Marshall et al.
6,419,023 B1 7/2002 George et al.
6,439,313 B1 8/2002 Thomeer et al.
6,457,525 B1 10/2002 Scott
6,467,546 B2 10/2002 Allamon et al.
6,470,965 B1 10/2002 Winzer
6,491,097 B1 12/2002 ONeal et al.
6,491,116 B2 12/2002 Berscheidt et al.
6,513,598 B2 2/2003 Moore et al.
6,540,033 B1 4/2003 Sullivan et al.
6,543,543 B2 4/2003 Muth
6,561,275 B2 5/2003 Glass et al.
6,588,507 B2 7/2003 Dusterhoft et al.
6,591,915 B2 7/2003 Burris et al.
6,601,648 B2 8/2003 Ebinger
6,601,650 B2 8/2003 Sundararajan
6,612,826 B1 9/2003 Bauer et al.
6,613,383 B1 9/2003 George et al.
6,619,400 B2 9/2003 Brunet
6,634,428 B2 10/2003 Krauss et al.
6,662,886 B2 12/2003 Russell
6,675,889 B1 1/2004 Mullins et al.
6,713,177 B2 3/2004 George et al.
6,715,541 B2 4/2004 Pedersen et al.
6,719,051 B2 4/2004 Hailey, Jr. et al.
6,755,249 B2 6/2004 Robison et al.
6,776,228 B2 8/2004 Pedersen et al.
6,779,599 B2 8/2004 Mullins et al.
6,799,638 B2 10/2004 Butterfield, Jr.
6,810,960 B2 11/2004 Pia
6,817,414 B2 11/2004 Lee
6,831,044 B2 12/2004 Constien
6,883,611 B2 4/2005 Smith et al.
6,887,297 B2 5/2005 Winter et al.
6,896,061 B2 5/2005 Hriscu et al.
6,899,176 B2 5/2005 Hailey, Jr. et al.
6,913,827 B2 7/2005 George et al.
6,926,086 B2 8/2005 Patterson et al.
6,932,159 B2 8/2005 Hovem
6,939,388 B2 9/2005 Angeliu
6,945,331 B2 9/2005 Patel
6,959,759 B2 11/2005 Doane et al.
6,973,970 B2 12/2005 Johnston et al.
6,973,973 B2 12/2005 Howard et al.
6,983,796 B2 1/2006 Bayne et al.
6,986,390 B2 1/2006 Doane et al.
7,013,989 B2 3/2006 Hammond et al.
7,013,998 B2 3/2006 Ray et al.
7,017,664 B2 3/2006 Walker et al.
7,017,677 B2 3/2006 Keshavan et al.
7,021,389 B2 4/2006 Bishop et al.
7,025,146 B2 4/2006 King et al.
7,028,778 B2 4/2006 Krywitsky
7,044,230 B2 5/2006 Starr et al.
7,049,272 B2 5/2006 Sinclair et al.
7,051,805 B2 5/2006 Doane et al.
7,059,410 B2 6/2006 Bousche et al.
7,090,027 B1 8/2006 Williams
7,093,664 B2 8/2006 Todd et al.
7,096,945 B2 8/2006 Richards et al.
7,096,946 B2 8/2006 Jasser et al.
7,108,080 B2 9/2006 Tessari et al.
7,111,682 B2 9/2006 Blaisdell
7,141,207 B2 11/2006 Jandeska, Jr. et al.
7,150,326 B2 12/2006 Bishop et al.
7,163,066 B2 1/2007 Lehr
7,168,494 B2 1/2007 Starr et al.
7,174,963 B2 2/2007 Bertelsen
7,182,135 B2 2/2007 Szarka
7,210,527 B2 5/2007 Walker et al.
7,210,533 B2 5/2007 Starr et al.
7,217,311 B2 5/2007 Hong et al.
7,234,530 B2 6/2007 Gass
7,250,188 B2 7/2007 Dodelet et al.
7,255,172 B2 8/2007 Johnson
7,255,178 B2 8/2007 Slup et al.
7,264,060 B2 9/2007 Wills
7,267,178 B2 9/2007 Krywitsky
7,270,186 B2 9/2007 Johnson
7,287,592 B2 10/2007 Surjaatmadja et al.
7,311,152 B2 12/2007 Howard et al.
7,320,365 B2 1/2008 Pia
7,322,412 B2 1/2008 Badalamenti et al.
7,322,417 B2 1/2008 Rytlewski et al.
7,325,617 B2 2/2008 Murray
7,328,750 B2 2/2008 Swor et al.
7,331,388 B2 2/2008 Vilela et al.
7,337,854 B2 3/2008 Horn et al.
7,346,456 B2 3/2008 Le Bemadjiel
7,350,582 B2 4/2008 McKeachnie et al.
7,353,879 B2 4/2008 Todd et al.
7,360,593 B2 4/2008 Constien
7,360,597 B2 4/2008 Blaisdell
7,363,970 B2 4/2008 Corre et al.
7,387,165 B2 6/2008 Lopez de Cardenas et al.
7,401,648 B2 7/2008 Richard
7,416,029 B2 8/2008 Telfer et al.
7,426,964 B2 9/2008 Lynde et al.
7,441,596 B2 10/2008 Wood et al.
7,445,049 B2 11/2008 Howard et al.
7,451,815 B2 11/2008 Hailey, Jr.
7,451,817 B2 11/2008 Reddy et al.
7,461,699 B2 12/2008 Richard et al.
7,464,764 B2 12/2008 Xu
7,472,750 B2 1/2009 Walker et al.
7,478,676 B2 1/2009 East, Jr. et al.
7,503,399 B2 3/2009 Badalamenti et al.
7,509,993 B1 3/2009 Turng et al.
7,510,018 B2 3/2009 Williamson et al.
7,513,311 B2 4/2009 Gramstad et al.
7,527,103 B2 5/2009 Huang et al.
7,537,825 B1 5/2009 Wardle et al.
7,552,777 B2 6/2009 Murray et al.
7,552,779 B2 6/2009 Murray
7,559,357 B2 7/2009 Clem
7,575,062 B2 8/2009 East, Jr.
7,579,087 B2 8/2009 Maloney et al.
7,591,318 B2 9/2009 Tilghman
7,600,572 B2 10/2009 Slup et al.
7,604,049 B2 10/2009 Vaidya et al.
7,635,023 B2 12/2009 Goldberg et al.
7,640,988 B2 1/2010 Phi et al.
7,661,480 B2 2/2010 Al-Anazi
7,661,481 B2 2/2010 Todd et al.
7,665,537 B2 2/2010 Patel et al.
7,686,082 B2 3/2010 Marsh
7,690,436 B2 4/2010 Turley et al.
7,699,101 B2 4/2010 Fripp et al.
7,703,511 B2 4/2010 Buyers et al.
7,708,078 B2 5/2010 Stoesz
7,709,421 B2 5/2010 Jones et al.
7,712,541 B2 5/2010 Loretz et al.
7,723,272 B2 5/2010 Crews et al.
7,726,406 B2 6/2010 Xu
7,757,773 B2 7/2010 Rytlewski
7,762,342 B2 7/2010 Richard et al.

(56) References Cited

U.S. PATENT DOCUMENTS 7,770,652 B2 8/2010 Barnett
7,775,284 B2 8/2010 Richards et al.
7,775,286 B2 8/2010 Duphorne
7,784,543 B2 8/2010 Johnson
7,798,225 B2 9/2010 Giroux et al.
7,798,226 B2 9/2010 Themig
7,798,236 B2 9/2010 McKeachnie et al.
7,806,189 B2 10/2010 Frazier
7,806,192 B2 10/2010 Foster et al.
7,810,553 B2 10/2010 Cruickshank et al.
7,810,567 B2 10/2010 Daniels et al.
7,819,198 B2 10/2010 Birckhead et al.
7,828,055 B2 11/2010 Willauer et al.
7,833,944 B2 11/2010 Munoz et al.
7,849,927 B2 12/2010 Herrera
7,855,168 B2 12/2010 Fuller et al.
7,861,781 B2 1/2011 D'Arcy
7,874,365 B2 1/2011 East, Jr. et al.
7,878,253 B2 2/2011 Stowe et al.
7,896,091 B2 3/2011 Williamson et al.
7,897,063 B1 3/2011 Perry et al.
7,900,696 B1 3/2011 Nish et al.
7,900,703 B2 3/2011 Clark et al.
7,909,096 B2 3/2011 Clark et al.
7,909,104 B2 3/2011 Bjorgum
7,909,110 B2 3/2011 Sharma et al.
7,913,765 B2 3/2011 Crow et al.
7,931,093 B2 4/2011 Foster et al.
7,938,191 B2 5/2011 Vaidya
7,946,340 B2 5/2011 Surjaatmadja et al.
7,958,940 B2 6/2011 Jameson
7,963,331 B2 6/2011 Surjaatmadja et al.
7,963,340 B2 6/2011 Gramstad et al.
7,963,342 B2 6/2011 George
7,980,300 B2 7/2011 Roberts et al.
7,987,906 B1 8/2011 Troy
8,020,619 B1 9/2011 Robertson et al.
8,020,620 B2 9/2011 Daniels et al.
8,025,104 B2 9/2011 Cooke, Jr.
8,028,767 B2 10/2011 Radford et al.
8,033,331 B2 10/2011 Themig
8,039,422 B1 10/2011 Al-Zahrani
8,056,628 B2 11/2011 Whitsitt et al.
8,056,638 B2 11/2011 Clayton et al.
8,127,856 B1 * 3/2012 Nish et al. ..... 166/376
8,403,037 B2 3/2013 Agrawal et al.
2001/0045285 A1 11/2001 Russell
2001/0045288 A1 11/2001 Allamon et al.
2002/0000319 A1 1/2002 Brunet
2002/0007948 A1 1/2002 Bayne et al.
2002/0014268 A1 2/2002 Vann
2002/0066572 A1 6/2002 Muth
2002/0104616 A1 8/2002 De et al.
2002/0136904 A1 9/2002 Glass et al.
2002/0162661 A1 11/2002 Krauss et al.
2003/0037925 A1 2/2003 Walker et al.
2003/0075326 A1 4/2003 Ebinger
2003/0111728 A1 6/2003 Thai et al.
2003/0141060 A1 7/2003 Hailey et al.
2003/0141061 A1 7/2003 Hailey et al.
2003/0141079 A1 7/2003 Doane et al.
2003/0150614 A1 8/2003 Brown et al.
2003/0155114 A1 8/2003 Pedersen et al.
2003/0155115 A1 8/2003 Pedersen et al.
2003/0159828 A1 8/2003 Howard et al.
2003/0164237 A1 9/2003 Butterfield
2003/0183391 A1 10/2003 Hriscu et al.
2004/0005483 A1 1/2004 Lin
2004/0020832 A1 2/2004 Richards et al.
2004/0045723 A1 3/2004 Slup et al.
2004/0089449 A1 5/2004 Walton et al.
2004/0159428 A1 8/2004 Hammond et al.
2004/0182583 A1 9/2004 Doane et al.
2004/0231845 A1 11/2004 Cooke, Jr.
2004/0256109 A1 12/2004 Johnson
2004/0256157 A1 12/2004 Tessari et al.
2005/0034876 A1 2/2005 Doane et al.
2005/0051329 A1 3/2005 Blaisdell
2005/0069449 A1 3/2005 Jackson et al.
2005/0102255 A1 5/2005 Bultman
2005/0161212 A1 7/2005 Leismer et al.
2005/0161224 A1 7/2005 Starr et al.
2005/0165149 A1 7/2005 Chanak et al.
2005/0194143 A1 9/2005 Xu et al.
2005/0205264 A1 9/2005 Starr et al.
2005/0205265 A1 9/2005 Todd et al.
2005/0205266 A1 9/2005 Todd et al.
2005/0241824 A1 11/2005 Burris, II et al.
2005/0241825 A1 11/2005 Burris, II et al.
2005/0257936 A1 11/2005 Lehr
2006/0012087 A1 1/2006 Matsuda et al.
2006/0045787 A1 3/2006 Jandeska, Jr. et al.
2006/0057479 A1 3/2006 Niimi et al.
2006/0081378 A1 4/2006 Howard et al.
2006/0102871 A1 5/2006 Wang et al.
2006/0108126 A1 5/2006 Horn et al.
2006/0110615 A1 5/2006 Karim et al.
2006/0116696 A1 6/2006 Odermatt et al.
2006/0124310 A1 6/2006 Lopez de Cardenas
2006/0124312 A1 6/2006 Rytlewski et al.
2006/0131011 A1 6/2006 Lynde et al.
2006/0131031 A1 6/2006 McKeachnie et al.
2006/0144515 A1 7/2006 Tada et al.
2006/0151178 A1 7/2006 Howard et al.
2006/0162927 A1 7/2006 Walker et al.
2006/0213670 A1 9/2006 Bishop et al.
2006/0231253 A1 10/2006 Vilela et al.
2006/0283592 A1 12/2006 Sierra et al.
2007/0017674 A1 1/2007 Blaisdell
2007/0017675 A1 1/2007 Hammami et al.
2007/0029082 A1 2/2007 Giroux et al.
2007/0039741 A1 2/2007 Hailey
2007/0044958 A1 3/2007 Rytlewski et al.
2007/0044966 A1 3/2007 Davies et al.
2007/0051521 A1 3/2007 Fike et al.
2007/0054101 A1 3/2007 Sigalas et al.
2007/0057415 A1 3/2007 Katagiri et al.
2007/0062644 A1 3/2007 Nakamura et al.
2007/0074873 A1 4/2007 McKeachnie et al.
2007/0107908 A1 * 5/2007 Vaidya et al. ..... 166/376
2007/0108060 A1 5/2007 Park
2007/0119600 A1 5/2007 Slup et al.
2007/0131912 A1 6/2007 Simone et al.
2007/0151009 A1 7/2007 Conrad, III et al.
2007/0151769 A1 7/2007 Slutz et al.
2007/0169935 A1 7/2007 Akbar et al.
2007/0181224 A1 * 8/2007 Marya et al. ..... 148/400
2007/0185655 A1 8/2007 Le Bemadjiel
2007/0187095 A1 8/2007 Walker et al.
2007/0221373 A1 * 9/2007 Murray ..... 166/192
2007/0221384 A1 9/2007 Murray
2007/0259994 A1 11/2007 Tour et al.
2007/0261862 A1 11/2007 Murray
2007/0272411 A1 11/2007 Lopez De Cardenas et al.
2007/0272413 A1 11/2007 Rytlewski et al.
2007/0277979 A1 12/2007 Todd et al.
2007/0284109 A1 12/2007 East et al.
2007/0299510 A1 12/2007 Venkatraman et al.
2008/0020923 A1 1/2008 Debe et al.
2008/0047707 A1 2/2008 Boney et al.
2008/0060810 A9 3/2008 Nguyen et al.
2008/0066923 A1 3/2008 Xu
2008/0066924 A1 3/2008 Xu
2008/0078553 A1 4/2008 George
2008/0081866 A1 4/2008 Gong et al.
2008/0099209 A1 5/2008 Loretz et al.
2008/0105438 A1 5/2008 Jordan et al.
2008/0115932 A1 5/2008 Cooke
2008/0121436 A1 5/2008 Slay et al.
2008/0127475 A1 6/2008 Griffo
2008/0149325 A1 6/2008 Crawford
2008/0149345 A1 6/2008 Marya et al.
2008/0149351 A1 6/2008 Marya et al.
2008/0169105 A1 7/2008 Williamson et al.

(56) References Cited

U.S. PATENT DOCUMENTS

| | | | | |
|---|---|---|---|---|
| 2008/0179104 | A1 | 7/2008 | Zhang et al. | |
| 2008/0202764 | A1 | 8/2008 | Clayton et al. | |
| 2008/0223586 | A1 | 9/2008 | Barnett | |
| 2008/0223587 | A1 | 9/2008 | Cherewyk | |
| 2008/0236829 | A1 | 10/2008 | Lynde | |
| 2008/0248205 | A1 | 10/2008 | Blanchet et al. | |
| 2008/0277109 | A1 | 11/2008 | Vaidya | |
| 2008/0277980 | A1 | 11/2008 | Koda et al. | |
| 2008/0296024 | A1 | 12/2008 | Huang et al. | |
| 2008/0314581 | A1 | 12/2008 | Brown | |
| 2008/0314588 | A1 | 12/2008 | Langlais et al. | |
| 2009/0038858 | A1 | 2/2009 | Griffo et al. | |
| 2009/0044946 | A1 | 2/2009 | Schasteen et al. | |
| 2009/0044949 | A1 | 2/2009 | King et al. | |
| 2009/0084556 | A1 | 4/2009 | Richards et al. | |
| 2009/0084600 | A1 | 4/2009 | Severance | |
| 2009/0107684 | A1 | 4/2009 | Cooke, Jr. | |
| 2009/0145666 | A1 | 6/2009 | Radford et al. | |
| 2009/0152009 | A1 | 6/2009 | Slay et al. | |
| 2009/0159289 | A1* | 6/2009 | Avant et al. | 166/316 |
| 2009/0178808 | A1 | 7/2009 | Williamson et al. | |
| 2009/0194273 | A1 | 8/2009 | Surjaatmadja et al. | |
| 2009/0205841 | A1 | 8/2009 | Kluge et al. | |
| 2009/0226340 | A1 | 9/2009 | Marya | |
| 2009/0242202 | A1 | 10/2009 | Rispler et al. | |
| 2009/0242208 | A1 | 10/2009 | Bolding | |
| 2009/0242214 | A1 | 10/2009 | Foster et al. | |
| 2009/0255667 | A1 | 10/2009 | Clem et al. | |
| 2009/0255686 | A1 | 10/2009 | Richard et al. | |
| 2009/0260817 | A1 | 10/2009 | Gambier et al. | |
| 2009/0272544 | A1 | 11/2009 | Giroux et al. | |
| 2009/0283270 | A1 | 11/2009 | Langeslag | |
| 2009/0301730 | A1 | 12/2009 | Gweily | |
| 2009/0308588 | A1 | 12/2009 | Howell et al. | |
| 2009/0317556 | A1 | 12/2009 | Macary | |
| 2010/0015002 | A1 | 1/2010 | Barrera et al. | |
| 2010/0025255 | A1 | 2/2010 | Su et al. | |
| 2010/0032151 | A1 | 2/2010 | Duphorne | |
| 2010/0044041 | A1 | 2/2010 | Smith et al. | |
| 2010/0051278 | A1 | 3/2010 | Mytopher et al. | |
| 2010/0089583 | A1 | 4/2010 | Xu et al. | |
| 2010/0089587 | A1 | 4/2010 | Stout | |
| 2010/0101803 | A1 | 4/2010 | Clayton et al. | |
| 2010/0139930 | A1 | 6/2010 | Patel et al. | |
| 2010/0200230 | A1 | 8/2010 | East, Jr. et al. | |
| 2010/0236793 | A1 | 9/2010 | Bjorgum | |
| 2010/0236794 | A1 | 9/2010 | Duan et al. | |
| 2010/0243254 | A1 | 9/2010 | Murphy et al. | |
| 2010/0252273 | A1 | 10/2010 | Duphorne | |
| 2010/0252280 | A1 | 10/2010 | Swor et al. | |
| 2010/0270031 | A1* | 10/2010 | Patel | 166/376 |
| 2010/0294510 | A1* | 11/2010 | Holmes | 166/376 |
| 2011/0005773 | A1 | 1/2011 | Dusterhoft et al. | |
| 2011/0036592 | A1 | 2/2011 | Fay | |
| 2011/0048743 | A1 | 3/2011 | Stafford et al. | |
| 2011/0056692 | A1 | 3/2011 | Lopez de Cardenas et al. | |
| 2011/0067872 | A1 | 3/2011 | Agrawal | |
| 2011/0067889 | A1 | 3/2011 | Marya et al. | |
| 2011/0067890 | A1 | 3/2011 | Themig | |
| 2011/0100643 | A1 | 5/2011 | Themig et al. | |
| 2011/0127044 | A1 | 6/2011 | Radford et al. | |
| 2011/0132143 | A1 | 6/2011 | Xu et al. | |
| 2011/0132612 | A1 | 6/2011 | Agrawal et al. | |
| 2011/0132619 | A1* | 6/2011 | Agrawal et al. | 166/376 |
| 2011/0132620 | A1* | 6/2011 | Agrawal et al. | 166/376 |
| 2011/0132621 | A1* | 6/2011 | Agrawal et al. | 166/376 |
| 2011/0135530 | A1 | 6/2011 | Xu et al. | |
| 2011/0135805 | A1 | 6/2011 | Doucet et al. | |
| 2011/0135953 | A1 | 6/2011 | Xu et al. | |
| 2011/0136707 | A1 | 6/2011 | Xu et al. | |
| 2011/0139465 | A1 | 6/2011 | Tibbles et al. | |
| 2011/0147014 | A1 | 6/2011 | Chen et al. | |
| 2011/0186306 | A1* | 8/2011 | Marya et al. | 166/386 |
| 2011/0214881 | A1* | 9/2011 | Newton et al. | 166/373 |
| 2011/0247833 | A1* | 10/2011 | Todd et al. | 166/386 |
| 2011/0253387 | A1 | 10/2011 | Ervin | |
| 2011/0259610 | A1 | 10/2011 | Shkurti et al. | |
| 2011/0277987 | A1 | 11/2011 | Frazier | |
| 2011/0277989 | A1 | 11/2011 | Frazier | |
| 2011/0284232 | A1 | 11/2011 | Huang | |
| 2011/0284240 | A1* | 11/2011 | Chen et al. | 166/373 |
| 2011/0284243 | A1 | 11/2011 | Frazier | |
| 2012/0118583 | A1* | 5/2012 | Johnson et al. | 166/376 |
| 2012/0168152 | A1* | 7/2012 | Casciaro | 166/250.03 |
| 2012/0211239 | A1* | 8/2012 | Kritzler et al. | 166/372 |
| 2013/0105159 | A1 | 5/2013 | Alvarez et al. | |

FOREIGN PATENT DOCUMENTS

| | | | |
|---|---|---|---|
| GB | 912956 | | 12/1962 |
| JP | 61067770 | | 4/1986 |
| JP | 08232029 | | 9/1996 |
| JP | 2000185725 | A1 | 7/2000 |
| JP | 2004225084 | | 8/2004 |
| JP | 2004225765 | A | 8/2004 |
| JP | 2005076052 | A | 3/2005 |
| JP | 2010502840 | A | 1/2010 |
| WO | 2008057045 | A1 | 5/2008 |
| WO | WO2008079485 | | 7/2008 |
| WO | 2009079745 | A1 | 7/2009 |
| WO | 2011071902 | A3 | 6/2011 |
| WO | 2011071910 | A3 | 6/2011 |

OTHER PUBLICATIONS

Joel Shaw, "Benefits and Application of a Surface-Controlled Sliding Sleeve for Fracturing Operations"; Society of Petroleum Engineers, SPE Paper No. 147546; Oct. 30, 2011; 8 pages.

Patent Cooperation Treaty International Search Report and Written Opinion for International Patent Application No. PCT/US2012/034978 filed on Apr. 25, 2012, mailed on Nov. 12, 2012.

Lunder et al.; "The Role of Mg17Al12 Phase in the Corrosion of Mg Alloy AZ91"; Corrosion; 45(9); pp. 741-748; (1989).

Stephen P. Mathis, "Sand Management: A Review of Approaches and Concerns"; Society of Petroleum Engineers, SPE Paper No. 82240; SPE European Formation Damage Conference, The Hague, The Netherlands, May 13-14, 2003.

Xiaowu Nie, Patents of Methods to Prepare Intermetallic Matrix Composites: A Review, Recent Patents on Materials Science 2008, 1, 232-240, Department of Scientific Research, Hunan Railway College of Science and Technology, Zhuzhou, P.R. China.

Optisleeve Sliding Sleeve, [online]; [retrieved on Jun. 25, 2010]; retrieved from the Internet weatherford.com/weatherford/groups/.../weatherfordcorp/WFT033159.pdf.

Pardo, et al.; "Corrosion Behaviour of Magnesium/Aluminium Alloys in 3.5 wt% NaC1"; Corrosion Science; 50; pp. 823-834; (2008).

Notification of Transmittal of the International Search Report and Written Opinion, Mailed Jul. 8, 2011, International Appln. No. PCT/US2010/059263, Written Opinion 4 Pages, International Search Report 3 Pages.

Shi et al.; "Influence of the Beta Phase on the Corrosion Performance of Anodised Coatings on Magnesium-Aluminium Alloys"; Corrosion Science; 47; pp. 2760-2777; (2005).

Shimizu et al., "Multi-walled carbon nanotube-reinforced magnesium alloy composites", Scripta Materialia, vol. 58, Issue 4, pp. 267-270.

"Sliding Sleeve", Omega Completion Technology Ltd, Sep. 29, 2009, retrieved on: www.omega-completion.com.

Song, et al.; "Corrosion Mechanisms of Magnesium Alloys"; Advanced Engineering Materials; 1(1); pp. 11-33; (1999).

Song, G. and S. Song. "A Possible Biodegradable Magnesium Implant Material," Advanced Engineering Materials, vol. 9, Issue 4, Apr. 2007, pp. 298-302.

Song, Guangling; "Recent Progress in Corrosion and Protection of Magnesium Alloys"; Advanced Engineering Materials; 7(7); pp. 563-586; (2005).

Song, et al.; "Influence of Microstructure on the Corrosion of Diecast AZ91D"; Corrosion Science; 41; pp. 249-273; (1999).

(56) References Cited

OTHER PUBLICATIONS

Song, et al.; "Corrosion Behaviour of AZ21, AZ501 and AZ91 in Sodium Chloride"; Corrosion Science; 40(10); pp. 1769-1791; (1998).
Song, et al.; "Understanding Magnesium Corrosion"; Advanced Engineering Materials; 5; No. 12; pp. 837-858; (2003).
Jing Sun, Lian Gao, Wei Li, "Colloidal Processing of Carbon Nanotube/Alumina Composites" Chem. Mater. 2002, 14, 5169-5172.
Xiaotong Wang et al., "Contact-Damage-Resistant Ceramic/Single-Wall Carbon Nanotubes and Ceramic/Graphite Composites" Nature Materials, vol. 3, Aug. 2004, pp. 539-544.
Welch, William R. et al., "Nonelastomeric Sliding Sleeve Maintains Long Term Integrity in HP/HT Application: Case Histories" [Abstract Only], SPE Eastern Regional Meeting, Oct. 23-25, 1996, Columbus. Ohio.
Y. Zhang and Hongjie Dai, "Formation of metal nanowires on suspended single-walled carbon nanotubes" Applied Physics Letter, vol. 77, No. 19 (2000), pp. 3015-3017.
Yihua Zhu, Chunzhong Li, Qiufang Wu, "The process of coating on ultrafine particles by surface hydrolysis reaction in a fluidized bed reactor", Surface and Coatings Technology 135 (2000) 14-17.
Zeng et al. "Progress and Challenge for Magnesium Alloys as Biomaterials," Advanced Engineering Materials, vol. 10, Issue 8, Aug. 2008, pp. B3-B14.
Guo-Dong Zhan, Joshua D. Kuntz, Julin Wan and Amiya K. Mukherjee, "Single-wall carbon nanotubes as attractive toughening agents in alumina-based nanocomposites" Nature Materials, vol. 2., Jan. 2003. 38-42.
Zhang, et al; "Study on the Environmentally Friendly Anodizing of AZ91D Magnesium Alloy"; Surface and Coatings Technology: 161; pp. 36-43; (2002).
Y. Zhang, Nathan W. Franklin, Robert J. Chen, Hongjie Dai, "Metal Coating on Suspended Carbon Nanotubes and its Implication to Metal—Tube Interaction", Chemical Physics Letters 331 (2000) 35-41.
Abdoulaye Seyni, Nadine Le Bolay, Sonia Molina-Boisseau, "On the interest of using degradable fillers in co-ground composite materials", Powder Technology 190, (2009) pp. 176-184.
Ambat, et al.; "Electroless Nickel-Plating on AZ91D Magnesium Alloy: Effect of Substrate Microstructure and Plating Parameters"; Surface and Coatings Technology; 179; pp. 124-134; (2004).
Baker Hughes Tools. "Baker Oil Tools Introduces Revolutionary Sand Control Completion Technology," May 2, 2005.
E. Paul Bercegeay et al., "A One-Trip Gravel Packing System"; Society of Petroleum Engineers, Offshort Technology Conference, SPE Paper No. 4771; Feb. 7-8, 1974.
Bybee, Karen. "One-Trip Completion System Eliminates Perforations," Completions Today, Sep. 2007, pp. 52-53.
CH. Christoglou, N. Voudouris, G.N. Angelopoulos, M. Pant, W. Dahl, "Deposition of Aluminum on Magnesium by a CVD Process", Surface and Coatings Technology 184 (2004) 149-155.
Chang, et al.; "Electrodeposition of Aluminum on Magnesium Alloy in Aluminum Chloride (A1C13)-1-ethyl-3-methylimidazolium chloride (EMIC) Ionic Liquid and Its Corrosion Behavior"; Electrochemistry Communications; 9; pp. 1602-1606; (2007).
Chun-Lin, Li. "Design of Abrasive Water Jet Perforation and Hydraulic Fracturing Tool," Oil Field Equipment, Mar. 2011.
Constantin Vahlas, Bri Gitte Caussat, Philippe Serp, George N. Angelopoulos, "Principles and Applications of CVD Powder Technology", Materials Science and Engineering R 53 (2006) 1-72.
Curtin, William and Brian Sheldon. "CNT-reinforced ceramics and metals," Materials Today, 2004, vol. 7, 44-49.
Yi Feng, Hailong Yuan, "Electroless Plating of Carbon Nanotubes with Silver" Journal of Materials Science, 39, (2004) pp. 3241-3243.
E. Flahaut et al., "Carbon Nanotube-Metal-Oxide Nanocomposites: Microstructure, Electrical Conductivity and Mechanical Properties" Acta mater. 48 (2000) 3803-3812.
Flow Control Systems, [online]; [retrieved on May 20, 2010]; retrieved from the Internet http://www.bakerhughes.com/products-and-services/completions-and-productions/well-completions/packers-and-flow-control/flow-control-systems.
Forsyth, et al.; "An Ionic Liquid Surface Treatment for Corrosion Protection of Magnesium Alloy AZ31"; Electrochem. Solid-State Lett./ 9(11); Abstract only; 1 page.
Forsyth, et al.; "Exploring Corrosion Protection of Mg Via Ionic Liquid Pretreatment"; Surface & Coatings Technology; 201; pp. 4496-4504; (2007).
Forsythe et al. An Ionic Liquid Surface Treatment for Corrosion Protection of Magnesium Alloy AZ31. Electrochem. Solid-State Lett., vol. 9, Issue 11, pp. B52-B55. Aug. 29, 2006.
Galanty et al. "Consolidation of metal powders during the extrusion process," Journal of Materials Processing Technology (2002), pp. 491-496.
C.S. Goh, J. Wei, L C Lee, and M. Gupta, "Development of novel carbon nanotube reinforced magnesium nanocomposites using the powder metallurgy technique", Nanotechnology 17 (2006) 7-12.
Guan Ling Song, Andrej Atrens "Corrosion Mechanisms of Magnesium Alloys", Advanced Engineering Materials 1999, 1, No. 1, pp. 11-33.
H. Hermawan, H. Alamdari, D. Mantovani and Dominique Dube, "Iron-manganese: new class of metallic degradable biomaterials prepared by powder metallurgy", Powder Metallurgy, vol. 51, No. 1, (2008), pp. 38-45.
Hjortstam et al. "Can we achieve ultra-low resistivity in carbon nanotube-based metal composites," Applied Physics A (2004), vol. 78, Issue 8, pp. 1175-1179.
Hsiao et al.; "Effect of Heat Treatment on Anodization and Electrochemical Behavior of AZ91D Magnesium Alloy"; J. Mater. Res.; 20(10); pp. 2763-2771;(2005).
Hsiao, et al.; "Anodization of AZ91D Magnesium Alloy in Silicate-Containing Electrolytes"; Surface & Coatings Technology; 199; pp. 127-134; (2005).
Hsiao, et al.; "Baking Treatment Effect on Materials Characteristics and Electrochemical Behavior of anodic Film Formed on AZ91D Magnesium Alloy"; Corrosion Science; 49; pp. 781-793; (2007).
Hsiao, et al.; "Characterization of Anodic Films Formed on AZ91D Magnesium Alloy"; Surface & Coatings Technology; 190; pp. 299-308; (2005).
Huo et al.; "Corrosion of AZ91D Magnesium Alloy with a Chemical Conversion Coating and Electroless Nickel Layer"; Corrosion Science: 46; pp. 1467-1477; (2004).
International Search Report and Written Opinion of the International Searching Authority, or the Declaration for PCT/US2011/058105 mailed from the Korean Intellectual Property Office on May 1, 2012.
Notification of Transmittal of the International Search Report and the Written Opinion of the International Searching Authority, or the Declaration mailed on Feb. 23, 2012 (Dated Feb. 22, 2012) for PCT/US2011/043036.
International Search Report and Written Opinion of the International Searching Authority for International Application No. PCT/US2011/058099 (filed on Oct. 27, 2011), mailed on May 11, 2012.
International Search Report and Written Opinion; Mail Date Jul. 28, 2011; International Application No. PCT/US2010/057763; International Filing date Nov. 23, 2010; Korean Intellectual Property Office; International Search Report 7 pages; Written Opinion 3 pages.
Notification of Transmittal of the International Search Report and the Written Opinion of the International Searching Authority; PCT/US2010/059257; Korean Intellectual Property Office; Mailed Jul. 27, 2011.
Notification of Transmittal of the International Search Report and the Written Opinion of the International Searching Authority; PCT/US2010/059259; International Searching Authority KIPO; Mailed Jun. 13, 2011.
Notification of Transmittal of the International Search Report and the Written Opinion of the International Searching Authority; PCT/US2010/059265; International Searching Authority KIPO; Mailed Jun. 16, 2011.

(56) References Cited

OTHER PUBLICATIONS

Notification of Transmittal of the International Search Report and the Written Opinion of the International Searching Authority; PCT/US2010/059268; International Searching Authority KIPO; Mailed Jun. 17, 2011.

Notification of Transmittal of the International Search Report and the Written Opinion of the International Searching Authority; PCT/US2011/047000; Korean Intellectual Property Office; Mailed Dec. 26, 2011; 8 pages.

J. Dutta Majumdar, B. Ramesh Chandra, B.L. Mordike, R. Galun, I. Manna, "Laser Surface Engineering of a Magnesium Alloy with Al + Al2O3", Surface and Coatings Technology 179 (2004) 297-305.

J.E. Gray, B. Luan, "Protective Coatings on Magnesium and Its Alloys—a Critical Review", Journal of Alloys and Compounds 336 (2002) 88-113.

Toru Kuzumaki, Osamu Ujiie, Hideki Ichinose, and Kunio Ito, "Mechanical Characteristics and Preparation of Carbon Nanotube Fiber-Reinforced Ti Composite", Advanced Engineering Materials, 2000, 2, No. 7.

Liu, et al.; "Electroless Nickel Plating on AZ91 Mg Alloy Substrate"; Surface & Coatings Technology; 200; pp. 5087-5093; (2006).

International Search Report and Written Opinion for International application No. PCT/US2012/034973 filed on Apr. 25, 2012, mailed on Nov. 29, 2012.

* cited by examiner

PLUG AND METHOD OF UNPLUGGING A SEAT

CROSS REFERENCE TO RELATED APPLICATIONS

This application contains subject matter related to the subject matter of co-pending applications, which are assigned to the same assignee as this application, Baker Hughes Incorporated of Houston, Tex. that were all filed on Dec. 8, 2009. The below listed applications are hereby incorporated by reference in their entirety:

U.S. patent application Ser. No. 12/633,682, entitled NANOMATRIX POWDER METAL COMPACT;

U.S. patent application Ser. No. 12/633,686, entitled COATED METALLIC POWDER AND METHOD OF MAKING THE SAME;

U.S. patent application Ser. No. 12/633,688, entitled METHOD OF MAKING A NANOMATRIX POWDER METAL COMPACT; and U.S. patent application Ser. No. 12/633,678, entitled ENGINEERED POWDER COMPACT COMPOSITE MATERIAL.

BACKGROUND

In the drilling and completion industry it is often desirable to utilize what is known to the art as tripping balls, darts, (generically plugs) for a number of different operations requiring pressure up events. As is known to one of skill in the art, tripping balls are dropped at selected times to seat in a downhole ball seat and create a seal there. The seal that is created is often intended to be temporary. After the operation for which the tripping ball was dropped is completed, the ball is removed from the wellbore by methods such as reverse circulating the ball out of the well. Doing so, however, requires that the ball dislodge from the seat. At times balls can become stuck to a seat thereby preventing it from being circulated out of the well, thereby requiring more time consuming and costly methods of removing the ball, such as, through drilling the ball out, for example. Devices and methods that allow an operator to remove a ball without resorting to such a costly process would be well received by the art.

BRIEF DESCRIPTION

Disclosed herein is a method of unplugging a seat, including dissolving at least a surface of a plug seated against the seat, and unseating the plug from the seat.

Also disclosed is a plug including a body having an outer surface configured to seatingly engage a seat wherein at least the outer surface of the plug is configured to dissolve upon exposure to a target environment.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
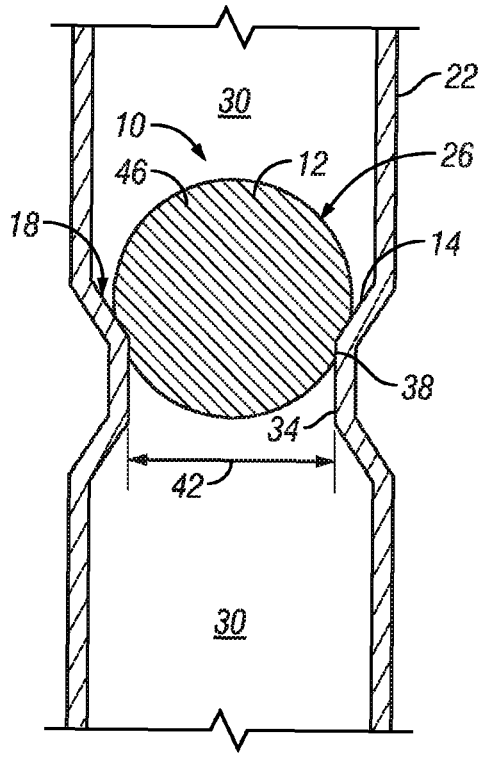
FIG. 1 depicts a cross sectional view of a plug disclosed herein within a tubular.

Referring to FIG. 1, an embodiment of a tripping ball, also described herein in a more generic term as a plug is illustrated generally at 10. Although the plug 10 is illustrated as a ball other shapes are contemplated such as conical, elliptical, etc. The plug 10 is configured to seatingly engage with a seat 14. The seat 14 illustrated herein includes a conical surface 18 sealingly engaged with a tubular 22. Seating engagement of the plug 10 with the seat 14 allows the body 12 to seal to the seat 14 thereby permitting pressure to be built thereagainst. The body 12 has an outer surface 26 that is configured to dissolve upon exposure to an environment 30 that is anticipated during deployment of the plug 10. This dissolution can include corrosion, for example, in applications wherein the outer surface 26 is part of an electrochemical cell. The dissolution of the outer surface 26 allows the body 12, when it has become stuck, wedged or lodged to the seat 14, to be dislodged and unsealed therefrom. This dislodging can be due, at least in part, to a decrease in frictional engagement between the plug 10 and the seat 14 as the body 12 begins to dissolve. Additionally, the dislodging is due to dimensional changes of the plug 10 as the body 12 dissolves initially from the outer surface 26.

The ability to dislodge the plug 10 from the seat 14 is particularly helpful in instances where the plug 10 has become wedged into an opening 34 of the seat 14. The severity of such wedging can be significant in cases where the body 12 has become deformed due to forces urging the plug 10 against the seat 14. Such deformation can cause a portion 38 of the body 12 to extend into the opening 34, thereby increasing frictional engagement between the portion 38 and a dimension 42 of the opening 34.

In applications for use in the drilling and completion industries, as discussed above, wherein the plug 10 is a tripping ball the ball will be exposed to a downhole environment 30. The downhole environment 30 may include high temperatures, high pressures, and wellbore fluids, such as, caustic chemicals, acids, bases and brine solutions, for example. By making the body 12 of a material 46 (This is not shown in any fig) that degrades in strength in the environment 30, the body 12 can be made to effectively dissolve in response to exposure to the downhole environment 30. The initiation of dissolution or disintegration of the body 12 can begin at the outer surface 26 as the strength of the outer surface 26 decreases first and can propagate to the balance of the body 12. Possible choices for the material 46 include but are not limited to Magnesium, polymeric adhesives such as structural methacrylate adhesive, high strength dissolvable Material (discussed in detail later in this specification), etc.

The body 12 and the outer surface 26 of the plug 10 in the embodiment of FIG. 1 are both made of the material 46. As such, dissolution of the material 46 can leave both the body 12 and the outer surface 26 in small pieces that are not detrimental to further operation of the well, thereby negating the need to either pump the body 12 out of the tubular 22 or run a tool within the wellbore to drill or mill the body 12 into pieces small enough to remove hindrance therefrom.

Figure 2:
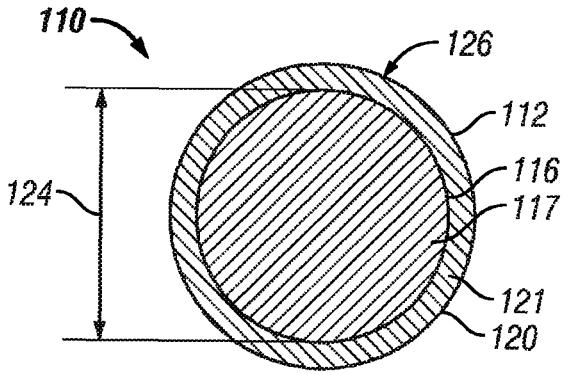
FIG. 2 depicts a cross sectional view of an alternate plug disclosed herein.

Referring to FIG. 2, an alternate embodiment of a plug disclosed herein is illustrated at 110. Unlike the plug 10 the plug 110 has a body 112 made of at least two different materials. The body 112 includes a core 116 made of a first material 117 and a shell 120 made of a second material 121. Since, in this embodiment, an outer surface 126 (this is not shown in the figs) that actually contacts the seat 14 is only on the shell 120, only the second material 121 needs to be dissolvable in the target environment 30. In contrast, the first material 117 may or may not be dissolvable in the environment 30.

If the first material 117 is not dissolvable it may be desirable to make a greatest dimension 124 of the core 116 less than the dimension 42 of the seat 14 to permit the core 116 to pass therethrough after dissolution of the shell 120. In so doing the core 116 can be run, or allowed to drop down, out of a lower end of the tubular 22 instead of being pumped upward to remove it therefrom.

As introduced above, further materials that may be utilized with the ball as described herein are lightweight, high-strength metallic materials are disclosed that may be used in a wide variety of applications and application environments, including use in various wellbore environments to make various selectably and controllably disposable or degradable lightweight, high-strength downhole tools or other downhole components, as well as many other applications for use in both durable and disposable or degradable articles. These lightweight, high-strength and selectably and controllably degradable materials include fully-dense, sintered powder compacts formed from coated powder materials that include various lightweight particle cores and core materials having various single layer and multilayer nanoscale coatings. These powder compacts are made from coated metallic powders that include various electrochemically-active (e.g., having relatively higher standard oxidation potentials) lightweight, high-strength particle cores and core materials, such as electrochemically active metals, that are dispersed within a cellular nanomatrix formed from the various nanoscale metallic coating layers of metallic coating materials, and are particularly useful in wellbore applications. These powder compacts provide a unique and advantageous combination of mechanical strength properties, such as compression and shear strength, low density and selectable and controllable corrosion properties, particularly rapid and controlled dissolution in various wellbore fluids. For example, the particle core and coating layers of these powders may be selected to provide sintered powder compacts suitable for use as high strength engineered materials having a compressive strength and shear strength comparable to various other engineered materials, including carbon, stainless and alloy steels, but which also have a low density comparable to various polymers, elastomers, low-density porous ceramics and composite materials. As yet another example, these powders and powder compact materials may be configured to provide a selectable and controllable degradation or disposal in response to a change in an environmental condition, such as a transition from a very low dissolution rate to a very rapid dissolution rate in response to a change in a property or condition of a wellbore proximate an article formed from the compact, including a property change in a wellbore fluid that is in contact with the powder compact. The selectable and controllable degradation or disposal characteristics described also allow the dimensional stability and strength of articles, such as wellbore tools or other components, made from these materials to be maintained until they are no longer needed, at which time a predetermined environmental condition, such as a wellbore condition, including wellbore fluid temperature, pressure or pH value, may be changed to promote their removal by rapid dissolution. These coated powder materials and powder compacts and engineered materials formed from them, as well as methods of making them, are described further below.

Figure 3:
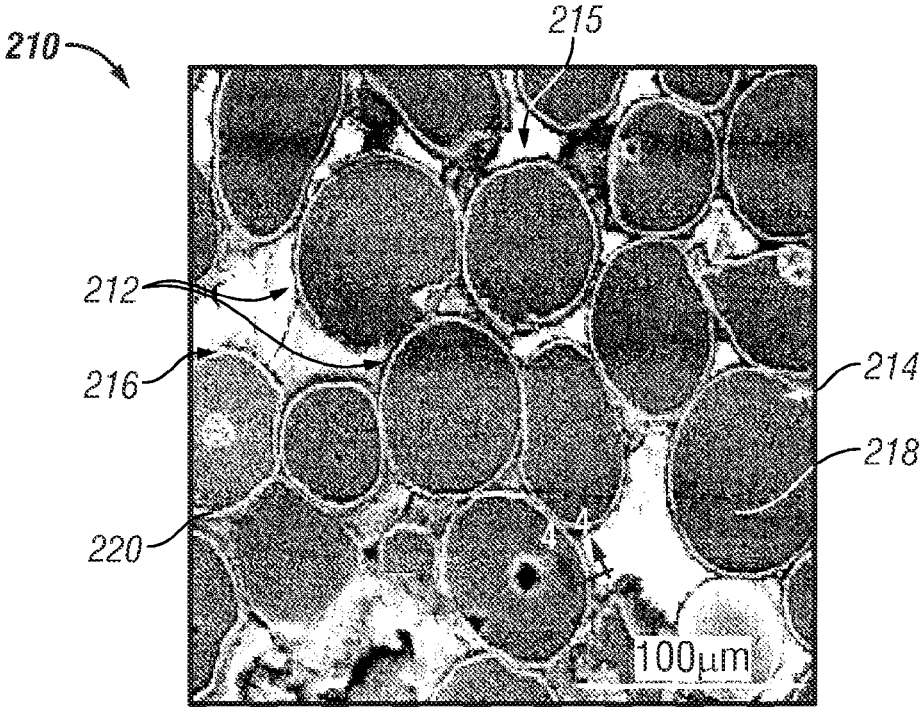
FIG. 3 is a photomicrograph of a powder 210 as disclosed herein that has been embedded in a potting material and sectioned.

Referring to FIG. 3, a metallic powder 210 includes a plurality of metallic, coated powder particles 212. Powder particles 212 may be formed to provide a powder 210, including free-flowing powder, that may be poured or otherwise disposed in all manner of forms or molds (not shown) having all manner of shapes and sizes and that may be used to fashion powder compacts 400 (FIGS. 6 and 7), as described herein, that may be used as, or for use in manufacturing, various articles of manufacture, including various wellbore tools and components.

Each of the metallic, coated powder particles 212 of powder 210 includes a particle core 214 and a metallic coating layer 216 disposed on the particle core 214. The particle core 214 includes a core material 218. The core material 218 may include any suitable material for forming the particle core 214 that provides powder particle 212 that can be sintered to form a lightweight, high-strength powder compact 400 having selectable and controllable dissolution characteristics. Suitable core materials include electrochemically active metals having a standard oxidation potential greater than or equal to that of Zn, including as Mg, Al, Mn or Zn or a combination thereof. These electrochemically active metals are very reactive with a number of common wellbore fluids, including any number of ionic fluids or highly polar fluids, such as those that contain various chlorides. Examples include fluids comprising potassium chloride (KCl), hydrochloric acid (HCl), calcium chloride ($CaCl_2$), calcium bromide ($CaBr_2$) or zinc bromide ($ZnBr_2$). Core material 218 may also include other metals that are less electrochemically active than Zn or non-metallic materials, or a combination thereof Suitable non-metallic materials include ceramics, composites, glasses or carbon, or a combination thereof. Core material 218 may be selected to provide a high dissolution rate in a predetermined wellbore fluid, but may also be selected to provide a relatively low dissolution rate, including zero dissolution, where dissolution of the nanomatrix material causes the particle core 214 to be rapidly undermined and liberated from the particle compact at the interface with the wellbore fluid, such that the effective rate of dissolution of particle compacts made using particle cores 214 of these core materials 218 is high, even though core material 218 itself may have a low dissolution rate, including core materials 220 that may be substantially insoluble in the wellbore fluid.

With regard to the electrochemically active metals as core materials 218, including Mg, Al, Mn or Zn, these metals may be used as pure metals or in any combination with one another, including various alloy combinations of these materials, including binary, tertiary, or quaternary alloys of these materials. These combinations may also include composites of these materials. Further, in addition to combinations with one another, the Mg, Al, Mn or Zn core materials 18 may also include other constituents, including various alloying additions, to alter one or more properties of the particle cores 214, such as by improving the strength, lowering the density or altering the dissolution characteristics of the core material 218.

Among the electrochemically active metals, Mg, either as a pure metal or an alloy or a composite material, is particularly useful, because of its low density and ability to form high-strength alloys, as well as its high degree of electrochemical activity, since it has a standard oxidation potential higher than Al, Mn or Zn. Mg alloys include all alloys that have Mg as an alloy constituent. Mg alloys that combine other electrochemically active metals, as described herein, as alloy constituents are particularly useful, including binary Mg—Zn, Mg—Al and Mg—Mn alloys, as well as tertiary Mg—Zn—Y and Mg—Al—X alloys, where X includes Zn, Mn, Si, Ca or Y, or a combination thereof These Mg—Al—X alloys may include, by weight, up to about 85% Mg, up to about 15% Al and up to about 5% X. Particle core 214 and core material 218, and particularly electrochemically active metals including Mg, Al, Mn or Zn, or combinations thereof, may also include a rare earth element or combination of rare earth elements. As used herein, rare earth elements include Sc, Y, La, Ce, Pr, Nd or Er, or a combination of rare earth elements. Where present, a rare earth element or combinations of rare earth elements may be present, by weight, in an amount of about 5% or less.

Particle core 214 and core material 218 have a melting temperature ($T_P$). As used herein, Tp includes the lowest temperature at which incipient melting or liquation or other forms of partial melting occur within core material 218, regardless of whether core material 218 comprises a pure metal, an alloy with multiple phases having different melting temperatures or a composite of materials having different melting temperatures.

Particle cores 214 may have any suitable particle size or range of particle sizes or distribution of particle sizes. For example, the particle cores 214 may be selected to provide an average particle size that is represented by a normal or Gaussian type unimodal distribution around an average or mean, as illustrated generally in FIG. 3. In another example, particle cores 214 may be selected or mixed to provide a multimodal distribution of particle sizes, including a plurality of average particle core sizes, such as, for example, a homogeneous bimodal distribution of average particle sizes. The selection of the distribution of particle core size may be used to determine, for example, the particle size and interparticle spacing 215 of the particles 212 of powder 210. In an exemplary embodiment, the particle cores 214 may have a unimodal distribution and an average particle diameter of about 5 μm to about 300 μm, more particularly about 80 μm to about 120 μm, and even more particularly about 100 μm.

Particle cores 214 may have any suitable particle shape, including any regular or irregular geometric shape, or combination thereof In an exemplary embodiment, particle cores 214 are substantially spheroidal electrochemically active metal particles. In another exemplary embodiment, particle cores 214 are substantially irregularly shaped ceramic particles. In yet another exemplary embodiment, particle cores 214 are carbon or other nanotube structures or hollow glass microspheres.

Figure 4:
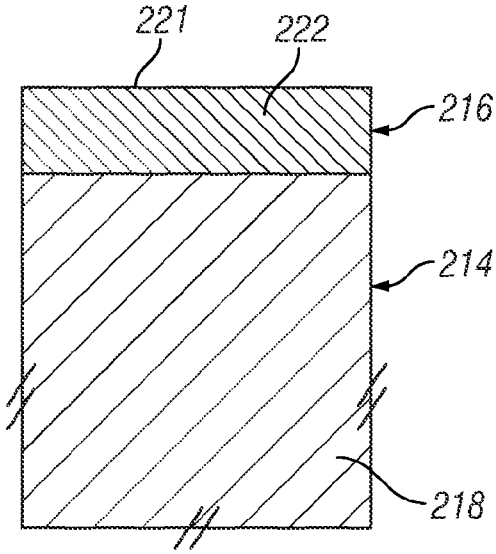
FIG. 4 is a schematic illustration of an exemplary embodiment of a powder particle 12 as it would appear in an exemplary section view represented by section 4-4 of FIG. 3.

Each of the metallic, coated powder particles 212 of powder 210 also includes a metallic coating layer 216 that is disposed on particle core 214. Metallic coating layer 216 includes a metallic coating material 220. Metallic coating material 220 gives the powder particles 212 and powder 210 its metallic nature. Metallic coating layer 216 is a nanoscale coating layer. In an exemplary embodiment, metallic coating layer 216 may have a thickness of about 25 nm to about 2500 nm. The thickness of metallic coating layer 216 may vary over the surface of particle core 214, but will preferably have a substantially uniform thickness over the surface of particle core 214. Metallic coating layer 216 may include a single layer, as illustrated in FIG. 4, or a plurality of layers as a multilayer coating structure. In a single layer coating, or in each of the layers of a multilayer coating, the metallic coating layer 216 may include a single constituent chemical element or compound, or may include a plurality of chemical elements or compounds. Where a layer includes a plurality of chemical constituents or compounds, they may have all manner of homogeneous or heterogeneous distributions, including a homogeneous or heterogeneous distribution of metallurgical phases. This may include a graded distribution where the relative amounts of the chemical constituents or compounds vary according to respective constituent profiles across the thickness of the layer. In both single layer and multilayer coatings 216, each of the respective layers, or combinations of them, may be used to provide a predetermined property to the powder particle 212 or a sintered powder compact formed therefrom. For example, the predetermined property may include the bond strength of the metallurgical bond between the particle core 214 and the coating material 220; the interdiffusion characteristics between the particle core 214 and metallic coating layer 216, including any interdiffusion between the layers of a multilayer coating layer 216; the interdiffusion characteristics between the various layers of a multilayer coating layer 216; the interdiffusion characteristics between the metallic coating layer 216 of one powder particle and that of an adjacent powder particle 212; the bond strength of the metallurgical bond between the metallic coating layers of adjacent sintered powder particles 212, including the outermost layers of multilayer coating layers; and the electrochemical activity of the coating layer 216.

Metallic coating layer 216 and coating material 220 have a melting temperature ($T_C$). As used herein, $T_C$ includes the lowest temperature at which incipient melting or liquation or other forms of partial melting occur within coating material 220, regardless of whether coating material 220 comprises a pure metal, an alloy with multiple phases each having different melting temperatures or a composite, including a composite comprising a plurality of coating material layers having different melting temperatures.

Metallic coating material 220 may include any suitable metallic coating material 220 that provides a sinterable outer surface 221 that is configured to be sintered to an adjacent powder particle 212 that also has a metallic coating layer 216 and sinterable outer surface 221. In powders 210 that also include second or additional (coated or uncoated) particles 232, as described herein, the sinterable outer surface 221 of metallic coating layer 216 is also configured to be sintered to a sinterable outer surface 221 of second particles 232. In an exemplary embodiment, the powder particles 212 are sinterable at a predetermined sintering temperature ($T_S$) that is a function of the core material 218 and coating material 220, such that sintering of powder compact 400 is accomplished entirely in the solid state and where $T_S$ is less than $T_P$ and $T_C$. Sintering in the solid state limits particle core 214/metallic coating layer 216 interactions to solid state diffusion processes and metallurgical transport phenomena and limits growth of and provides control over the resultant interface between them. In contrast, for example, the introduction of liquid phase sintering would provide for rapid interdiffusion of the particle core 214/metallic coating layer 216 materials and make it difficult to limit the growth of and provide control over the resultant interface between them, and thus interfere with the formation of the desirable microstructure of particle compact 400 as described herein.

In an exemplary embodiment, core material 218 will be selected to provide a core chemical composition and the coating material 220 will be selected to provide a coating chemical composition and these chemical compositions will also be selected to differ from one another. In another exemplary embodiment, the core material 218 will be selected to provide a core chemical composition and the coating material 220 will be selected to provide a coating chemical composition and these chemical compositions will also be selected to differ from one another at their interface. Differences in the chemical compositions of coating material 220 and core material 218 may be selected to provide different dissolution rates and selectable and controllable dissolution of powder compacts 400 that incorporate them making them selectably and controllably dissolvable. This includes dissolution rates that differ in response to a changed condition in the wellbore, including an indirect or direct change in a wellbore fluid. In an exemplary embodiment, a powder compact 400 formed from powder 210 having chemical compositions of core material 218 and coating material 220 that make compact 400 is selectably dissolvable in a wellbore fluid in response to a changed wellbore condition that includes a change in temperature, change in pressure, change in flow rate, change in pH or change in chemical composition of the wellbore fluid, or a combination thereof. The selectable dissolution response to the changed condition may result from actual chemical reactions or processes that promote different rates of dissolution, but also encompass changes in the dissolution response that are associated with physical reactions or processes, such as changes in wellbore fluid pressure or flow rate.

Figure 5:
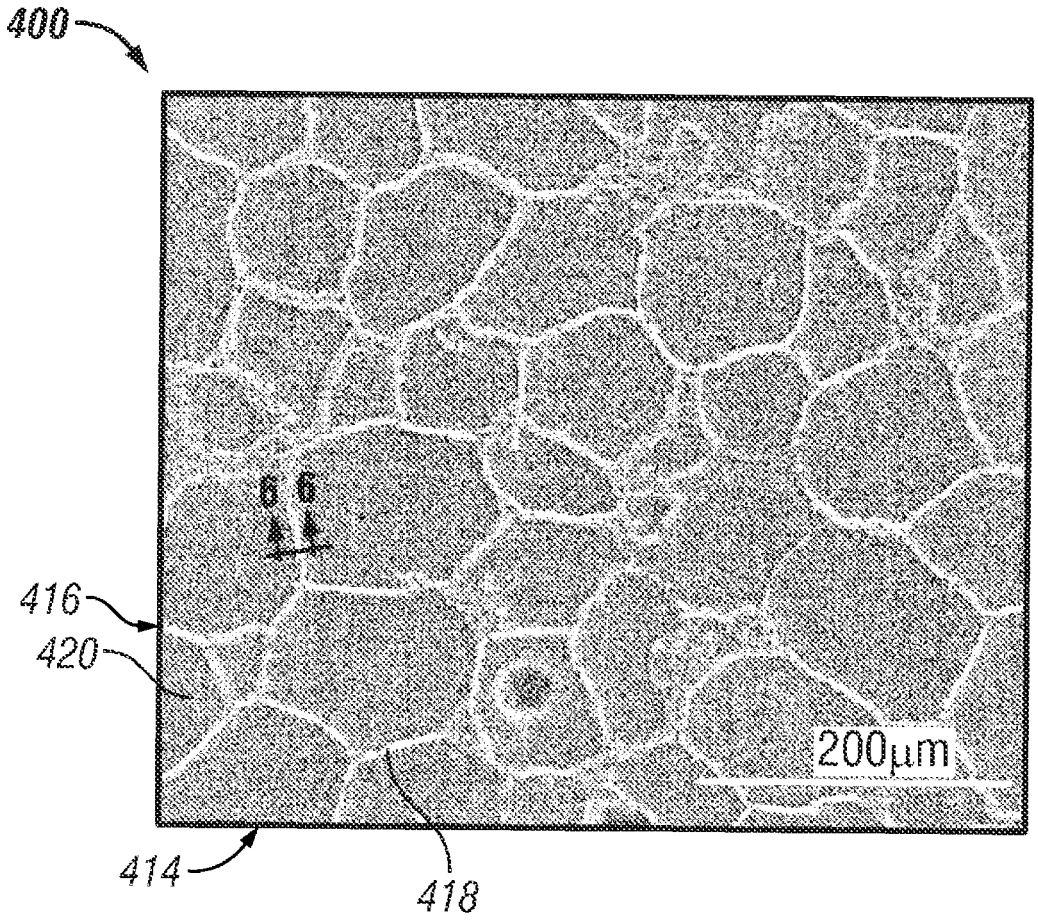
FIG. 5 is a photomicrograph of an exemplary embodiment of a powder compact as disclosed herein.

As illustrated in FIGS. 3 and 5, particle core 214 and core material 218 and metallic coating layer 216 and coating material 220 may be selected to provide powder particles 212 and a powder 210 that is configured for compaction and sintering to provide a powder compact 400 that is lightweight (i.e., having a relatively low density), high-strength and is selectably and controllably removable from a wellbore in response to a change in a wellbore property, including being selectably and controllably dissolvable in an appropriate wellbore fluid, including various wellbore fluids as disclosed herein. Powder compact 400 includes a substantially-continuous, cellular nanomatrix 416 of a nanomatrix material 420 having a plurality of dispersed particles 414 dispersed throughout the cellular nanomatrix 416. The substantially-continuous cellular nanomatrix 416 and nanomatrix material 420 formed of sintered metallic coating layers 216 is formed by the compaction and sintering of the plurality of metallic coating layers 216 of the plurality of powder particles 212. The chemical composition of nanomatrix material 420 may be different than that of coating material 220 due to diffusion effects associated with the sintering as described herein. Powder metal compact 400 also includes a plurality of dispersed particles 414 that comprise particle core material 418. Dispersed particle cores 414 and core material 418 correspond to and are formed from the plurality of particle cores 214 and core material 218 of the plurality of powder particles 212 as the metallic coating layers 216 are sintered together to form nanomatrix 416. The chemical composition of core material 418 may be different than that of core material 218 due to diffusion effects associated with sintering as described herein.

As used herein, the use of the term substantially-continuous cellular nanomatrix 416 does not connote the major constituent of the powder compact, but rather refers to the minority constituent or constituents, whether by weight or by volume. This is distinguished from most matrix composite materials where the matrix comprises the majority constituent by weight or volume. The use of the term substantially-continuous, cellular nanomatrix is intended to describe the extensive, regular, continuous and interconnected nature of the distribution of nanomatrix material 420 within powder compact 400. As used herein, "substantially-continuous" describes the extension of the nanomatrix material throughout powder compact 400 such that it extends between and envelops substantially all of the dispersed particles 414. Substantially-continuous is used to indicate that complete continuity and regular order of the nanomatrix around each dispersed particle 414 is not required. For example, defects in the coating layer 216 over particle core 214 on some powder particles 212 may cause bridging of the particle cores 214 during sintering of the powder compact 400, thereby causing localized discontinuities to result within the cellular nanomatrix 416, even though in the other portions of the powder compact the nanomatrix is substantially continuous and exhibits the structure described herein. As used herein, "cellular" is used to indicate that the nanomatrix defines a network of generally repeating, interconnected, compartments or cells of nanomatrix material 420 that encompass and also interconnect the dispersed particles 414. As used herein, "nanomatrix" is used to describe the size or scale of the matrix, particularly the thickness of the matrix between adjacent dispersed particles 414. The metallic coating layers that are sintered together to form the nanomatrix are themselves nanoscale thickness coating layers. Since the nanomatrix at most locations, other than the intersection of more than two dispersed particles 414, generally comprises the interdiffusion and bonding of two coating layers 216 from adjacent powder particles 212 having nanoscale thicknesses, the matrix formed also has a nanoscale thickness (e.g., approximately two times the coating layer thickness as described herein) and is thus described as a nanomatrix. Further, the use of the term dispersed particles 414 does not connote the minor constituent of powder compact 400, but rather refers to the majority constituent or constituents, whether by weight or by volume. The use of the term dispersed particle is intended to convey the discontinuous and discrete distribution of particle core material 418 within powder compact 400.

Powder compact 400 may have any desired shape or size, including that of a cylindrical billet or bar that may be machined or otherwise used to form useful articles of manufacture, including various wellbore tools and components. The sintering and pressing processes used to form powder compact 400 and deform the powder particles 212, including particle cores 214 and coating layers 216, to provide the full density and desired macroscopic shape and size of powder compact 400 as well as its microstructure. The microstructure of powder compact 400 includes an equiaxed configuration of dispersed particles 414 that are dispersed throughout and embedded within the substantially-continuous, cellular nanomatrix 416 of sintered coating layers. This microstructure is somewhat analogous to an equiaxed grain microstructure with a continuous grain boundary phase, except that it does not require the use of alloy constituents having thermodynamic phase equilibria properties that are capable of producing such a structure. Rather, this equiaxed dispersed particle structure and cellular nanomatrix 416 of sintered metallic coating layers 216 may be produced using constituents where thermodynamic phase equilibrium conditions would not produce an equiaxed structure. The equiaxed morphology of the dispersed particles 414 and cellular network 416 of particle layers results from sintering and deformation of the powder particles 212 as they are compacted and interdiffuse and deform to fill the interparticle spaces 215 (FIG. 3). The sintering temperatures and pressures may be selected to ensure that the density of powder compact 400 achieves substantially full theoretical density.

Figure 6:
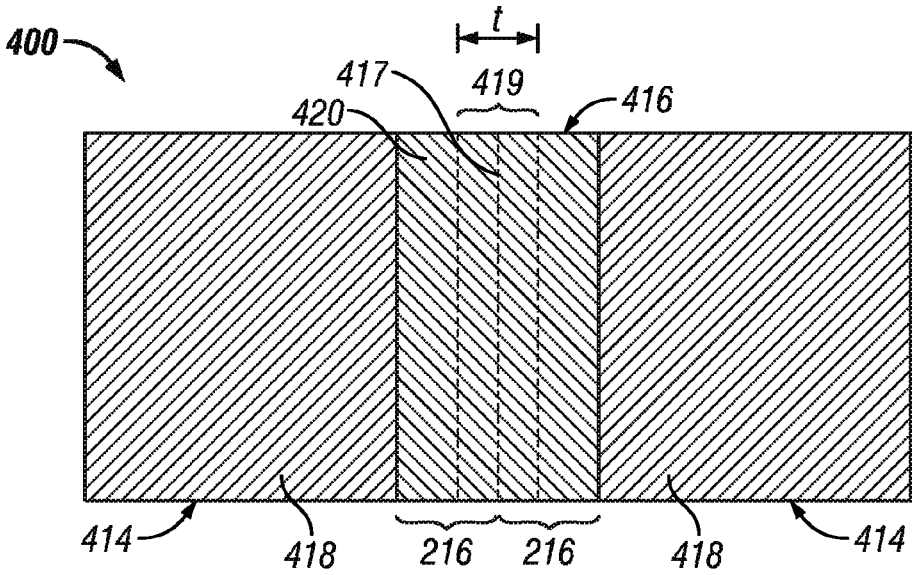
FIG. 6 is a schematic of illustration of an exemplary embodiment of a powder compact made using a powder having single-layer powder particles as it would appear taken along section 6-6 in FIG. 5.

In an exemplary embodiment as illustrated in FIGS. 3 and 5, dispersed particles 414 are formed from particle cores 214 dispersed in the cellular nanomatrix 416 of sintered metallic coating layers 216, and the nanomatrix 416 includes a solid-state metallurgical bond 417 or bond layer 419, as illustrated schematically in FIG. 6, extending between the dispersed particles 414 throughout the cellular nanomatrix 416 that is formed at a sintering temperature ($T_S$), where $T_S$ is less than $T_C$ and $T_P$. As indicated, solid-state metallurgical bond 417 is formed in the solid state by solid-state interdiffusion between the coating layers 216 of adjacent powder particles 212 that are compressed into touching contact during the compaction and sintering processes used to form powder compact 400, as described herein. As such, sintered coating layers 216 of cellular nanomatrix 416 include a solid-state bond layer 419 that has a thickness (t) defined by the extent of the interdiffusion of the coating materials 220 of the coating layers 216, which will in turn be defined by the nature of the coating layers 216, including whether they are single or multilayer coating layers, whether they have been selected to promote or limit such interdiffusion, and other factors, as described herein, as well as the sintering and compaction conditions, including the sintering time, temperature and pressure used to form powder compact 400.

As nanomatrix 416 is formed, including bond 417 and bond layer 419, the chemical composition or phase distribution, or both, of metallic coating layers 216 may change. Nanomatrix 416 also has a melting temperature ($T_M$). As used herein, $T_M$ includes the lowest temperature at which incipient melting or liquation or other forms of partial melting will occur within nanomatrix 416, regardless of whether nanomatrix material 420 comprises a pure metal, an alloy with multiple phases each having different melting temperatures or a composite, including a composite comprising a plurality of layers of various coating materials having different melting temperatures, or a combination thereof, or otherwise. As dispersed particles 414 and particle core materials 418 are formed in conjunction with nanomatrix 416, diffusion of constituents of metallic coating layers 216 into the particle cores 214 is also possible, which may result in changes in the chemical composition or phase distribution, or both, of particle cores 214. As a result, dispersed particles 414 and particle core materials 418 may have a melting temperature ($T_{DP}$) that is different than $T_P$. As used herein, $T_{DP}$ includes the lowest temperature at which incipient melting or liquation or other forms of partial melting will occur within dispersed particles 214, regardless of whether particle core material 218 comprise a pure metal, an alloy with multiple phases each having different melting temperatures or a composite, or otherwise. Powder compact 400 is formed at a sintering temperature ($T_S$), where $T_S$ is less than $T_C$, $T_P$, $T_M$ and $T_{DP}$.

Dispersed particles 414 may comprise any of the materials described herein for particle cores 214, even though the chemical composition of dispersed particles 414 may be different due to diffusion effects as described herein. In an exemplary embodiment, dispersed particles 414 are formed from particle cores 214 comprising materials having a standard oxidation potential greater than or equal to Zn, including Mg, Al, Zn or Mn, or a combination thereof, may include various binary, tertiary and quaternary alloys or other combinations of these constituents as disclosed herein in conjunction with particle cores 214. Of these materials, those having dispersed particles 414 comprising Mg and the nanomatrix 416 formed from the metallic coating materials 216 described herein are particularly useful. Dispersed particles 414 and particle core material 418 of Mg, Al, Zn or Mn, or a combination thereof, may also include a rare earth element, or a combination of rare earth elements as disclosed herein in conjunction with particle cores 214.

In another exemplary embodiment, dispersed particles 414 are formed from particle cores 214 comprising metals that are less electrochemically active than Zn or non-metallic materials. Suitable non-metallic materials include ceramics, glasses (e.g., hollow glass microspheres) or carbon, or a combination thereof, as described herein.

Dispersed particles 414 of powder compact 400 may have any suitable particle size, including the average particle sizes described herein for particle cores 214.

Dispersed particles 414 may have any suitable shape depending on the shape selected for particle cores 214 and powder particles 212, as well as the method used to sinter and compact powder 210. In an exemplary embodiment, powder particles 212 may be spheroidal or substantially spheroidal and dispersed particles 414 may include an equiaxed particle configuration as described herein.

The nature of the dispersion of dispersed particles 414 may be affected by the selection of the powder 210 or powders 210 used to make particle compact 400. In one exemplary embodiment, a powder 210 having a unimodal distribution of powder particle 212 sizes may be selected to form powder compact 2200 and will produce a substantially homogeneous unimodal dispersion of particle sizes of dispersed particles 414 within cellular nanomatrix 416, as illustrated generally in FIG. 5. In another exemplary embodiment, a plurality of powders 210 having a plurality of powder particles with particle cores 214 that have the same core materials 218 and different core sizes and the same coating material 220 may be selected and uniformly mixed as described herein to provide a powder 210 having a homogenous, multimodal distribution of powder particle 212 sizes, and may be used to form powder compact 400 having a homogeneous, multimodal dispersion of particle sizes of dispersed particles 414 within cellular nanomatrix 416. Similarly, in yet another exemplary embodiment, a plurality of powders 210 having a plurality of particle cores 214 that may have the same core materials 218 and different core sizes and the same coating material 220 may be selected and distributed in a non-uniform manner to provide a non-homogenous, multimodal distribution of powder particle sizes, and may be used to form powder compact 400 having a non-homogeneous, multimodal dispersion of particle sizes of dispersed particles 414 within cellular nanomatrix 416. The selection of the distribution of particle core size may be used to determine, for example, the particle size and interparticle spacing of the dispersed particles 414 within the cellular nanomatrix 416 of powder compacts 400 made from powder 210.

Nanomatrix 416 is a substantially-continuous, cellular network of metallic coating layers 216 that are sintered to one another. The thickness of nanomatrix 416 will depend on the nature of the powder 210 or powders 210 used to form powder compact 400, as well as the incorporation of any second powder 230, particularly the thicknesses of the coating layers associated with these particles. In an exemplary embodiment, the thickness of nanomatrix 416 is substantially uniform throughout the microstructure of powder compact 400 and comprises about two times the thickness of the coating layers 216 of powder particles 212. In another exemplary embodiment, the cellular network 416 has a substantially uniform average thickness between dispersed particles 414 of about 50 nm to about 5000 nm.

Nanomatrix 416 is formed by sintering metallic coating layers 216 of adjacent particles to one another by interdiffusion and creation of bond layer 419 as described herein. Metallic coating layers 216 may be single layer or multilayer structures, and they may be selected to promote or inhibit diffusion, or both, within the layer or between the layers of metallic coating layer 216, or between the metallic coating layer 216 and particle core 214, or between the metallic coating layer 216 and the metallic coating layer 216 of an adjacent powder particle, the extent of interdiffusion of metallic coating layers 216 during sintering may be limited or extensive depending on the coating thicknesses, coating material or materials selected, the sintering conditions and other factors. Given the potential complexity of the interdiffusion and interaction of the constituents, description of the resulting chemical composition of nanomatrix 416 and nanomatrix material 420 may be simply understood to be a combination of the constituents of coating layers 216 that may also include one or more constituents of dispersed particles 414, depending on the extent of interdiffusion, if any, that occurs between the dispersed particles 414 and the nanomatrix 416. Similarly, the chemical composition of dispersed particles 414 and particle core material 418 may be simply understood to be a combination of the constituents of particle core 214 that may also include one or more constituents of nanomatrix 416 and nanomatrix material 420, depending on the extent of interdiffusion, if any, that occurs between the dispersed particles 414 and the nanomatrix 416.

In an exemplary embodiment, the nanomatrix material 420 has a chemical composition and the particle core material 418 has a chemical composition that is different from that of nanomatrix material 420, and the differences in the chemical compositions may be configured to provide a selectable and controllable dissolution rate, including a selectable transition from a very low dissolution rate to a very rapid dissolution rate, in response to a controlled change in a property or condition of the wellbore proximate the compact 400, including a property change in a wellbore fluid that is in contact with the powder compact 400, as described herein. Nanomatrix 416 may be formed from powder particles 212 having single layer and multilayer coating layers 216. This design flexibility provides a large number of material combinations, particularly in the case of multilayer coating layers 216, that can be utilized to tailor the cellular nanomatrix 416 and composition of nanomatrix material 420 by controlling the interaction of the coating layer constituents, both within a given layer, as well as between a coating layer 216 and the particle core 214 with which it is associated or a coating layer 216 of an adjacent powder particle 212. Several exemplary embodiments that demonstrate this flexibility are provided below.

As illustrated in FIG. 6, in an exemplary embodiment, powder compact 400 is formed from powder particles 212 where the coating layer 216 comprises a single layer, and the resulting nanomatrix 416 between adjacent ones of the plurality of dispersed particles 414 comprises the single metallic coating layer 216 of one powder particle 212, a bond layer 419 and the single coating layer 216 of another one of the adjacent powder particles 212. The thickness (t) of bond layer 419 is determined by the extent of the interdiffusion between the single metallic coating layers 216, and may encompass the entire thickness of nanomatrix 416 or only a portion thereof. In one exemplary embodiment of powder compact 400 formed using a single layer powder 210, powder compact 400 may include dispersed particles 414 comprising Mg, Al, Zn or Mn, or a combination thereof, as described herein, and nanomatrix 416 may include Al, Zn, Mn, Mg, Mo, W, Cu, Fe, Si, Ca, Co, Ta, Re or Ni, or an oxide, carbide or nitride thereof, or a combination of any of the aforementioned materials, including combinations where the nanomatrix material 420 of cellular nanomatrix 416, including bond layer 419, has a chemical composition and the core material 418 of dispersed particles 414 has a chemical composition that is different than the chemical composition of nanomatrix material 416. The difference in the chemical composition of the nanomatrix material 420 and the core material 418 may be used to provide selectable and controllable dissolution in response to a change in a property of a wellbore, including a wellbore fluid, as described herein. In a further exemplary embodiment of a powder compact 400 formed from a powder 210 having a single coating layer configuration, dispersed particles 414 include Mg, Al, Zn or Mn, or a combination thereof, and the cellular nanomatrix 416 includes Al or Ni, or a combination thereof.

Figure 7:
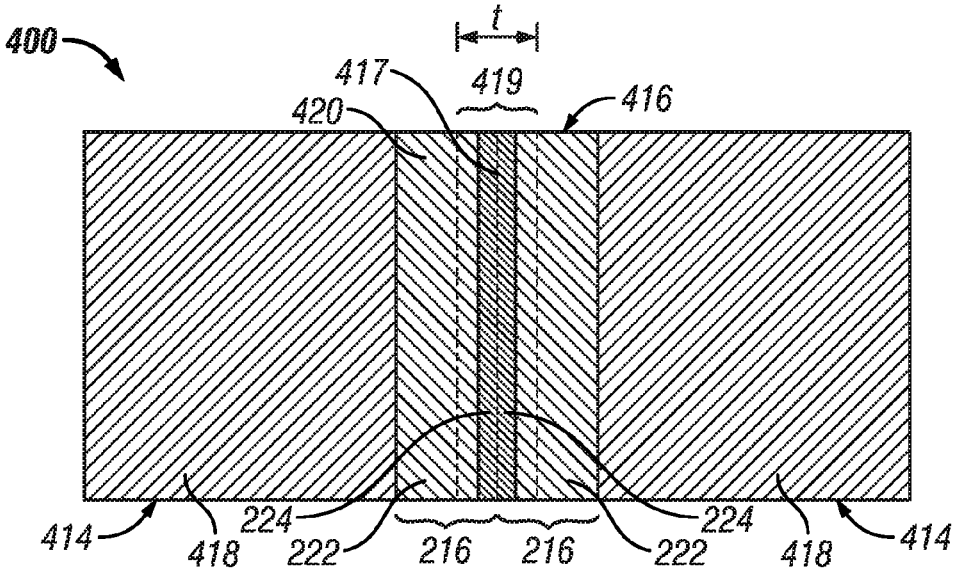
FIG. 7 is a schematic of illustration of another exemplary embodiment of a powder compact made using a powder having multilayer powder particles as it would appear taken along section 6-6 in FIG. 5.

As illustrated in FIG. 7, in another exemplary embodiment, powder compact 400 is formed from powder particles 212 where the coating layer 216 comprises a multilayer coating layer 216 having a plurality of coating layers, and the resulting nanomatrix 416 between adjacent ones of the plurality of dispersed particles 414 comprises the plurality of layers (t) comprising the coating layer 216 of one particle 212, a bond layer 419, and the plurality of layers comprising the coating layer 216 of another one of powder particles 212. In FIG. 7, this is illustrated with a two-layer metallic coating layer 216, but it will be understood that the plurality of layers of multilayer metallic coating layer 216 may include any desired number of layers. The thickness (t) of the bond layer 419 is again determined by the extent of the interdiffusion between the plurality of layers of the respective coating layers 216, and may encompass the entire thickness of nanomatrix 416 or only a portion thereof. In this embodiment, the plurality of layers comprising each coating layer 216 may be used to control interdiffusion and formation of bond layer 419 and thickness (t).

Sintered and forged powder compacts 400 that include dispersed particles 414 comprising Mg and nanomatrix 416 comprising various nanomatrix materials as described herein have demonstrated an excellent combination of mechanical strength and low density that exemplify the lightweight, high-strength materials disclosed herein. Examples of powder compacts 400 that have pure Mg dispersed particles 414 and various nanomatrices 416 formed from powders 210 having pure Mg particle cores 214 and various single and multilayer metallic coating layers 216 that include Al, Ni, W or $Al_2O_3$, or a combination thereof. These powders compacts 400 have been subjected to various mechanical and other testing, including density testing, and their dissolution and mechanical property degradation behavior has also been characterized as disclosed herein. The results indicate that these materials may be configured to provide a wide range of selectable and controllable corrosion or dissolution behavior from very low corrosion rates to extremely high corrosion rates, particularly corrosion rates that are both lower and higher than those of powder compacts that do not incorporate the cellular nanomatrix, such as a compact formed from pure Mg powder through the same compaction and sintering processes in comparison to those that include pure Mg dispersed particles in the various cellular nanomatrices described herein. These powder compacts 200 may also be configured to provide substantially enhanced properties as compared to powder compacts formed from pure Mg particles that do not include the nanoscale coatings described herein. Powder compacts 400 that include dispersed particles 414 comprising Mg and nanomatrix 416 comprising various nanomatrix materials 420 described herein have demonstrated room temperature compressive strengths of at least about 37 ksi, and have further demonstrated room temperature compressive strengths in excess of about 50 ksi, both dry and immersed in a solution of 3% KCl at 200° F. In contrast, powder compacts formed from pure Mg powders have a compressive strength of about 20 ksi or less. Strength of the nanomatrix powder metal compact 400 can be further improved by optimizing powder 210, particularly the weight percentage of the nanoscale metallic coating layers 16 that are used to form cellular nanomatrix 416. Strength of the nanomatrix powder metal compact 400 can be further improved by optimizing powder 210, particularly the weight percentage of the nanoscale metallic coating layers 216 that are used to form cellular nanomatrix 416. For example, varying the weight percentage (wt. %), i.e., thickness, of an alumina coating within a cellular nanomatrix 416 formed from coated powder particles 212 that include a multilayer ($Al/Al_2O_3/Al$) metallic coating layer 216 on pure Mg particle cores 214 provides an increase of 21% as compared to that of 0 wt % alumina.

Powder compacts 400 comprising dispersed particles 414 that include Mg and nanomatrix 416 that includes various nanomatrix materials as described herein have also demonstrated a room temperature sheer strength of at least about 20 ksi. This is in contrast with powder compacts formed from pure Mg powders which have room temperature sheer strengths of about 8 ksi.

Powder compacts 400 of the types disclosed herein are able to achieve an actual density that is substantially equal to the predetermined theoretical density of a compact material based on the composition of powder 210, including relative amounts of constituents of particle cores 214 and metallic coating layer 216, and are also described herein as being fully-dense powder compacts. Powder compacts 400 comprising dispersed particles that include Mg and nanomatrix 416 that includes various nanomatrix materials as described herein have demonstrated actual densities of about 1.738 $g/cm^3$ to about 2.50 $g/cm^3$, which are substantially equal to the predetermined theoretical densities, differing by at most 4% from the predetermined theoretical densities.

Figure 8:
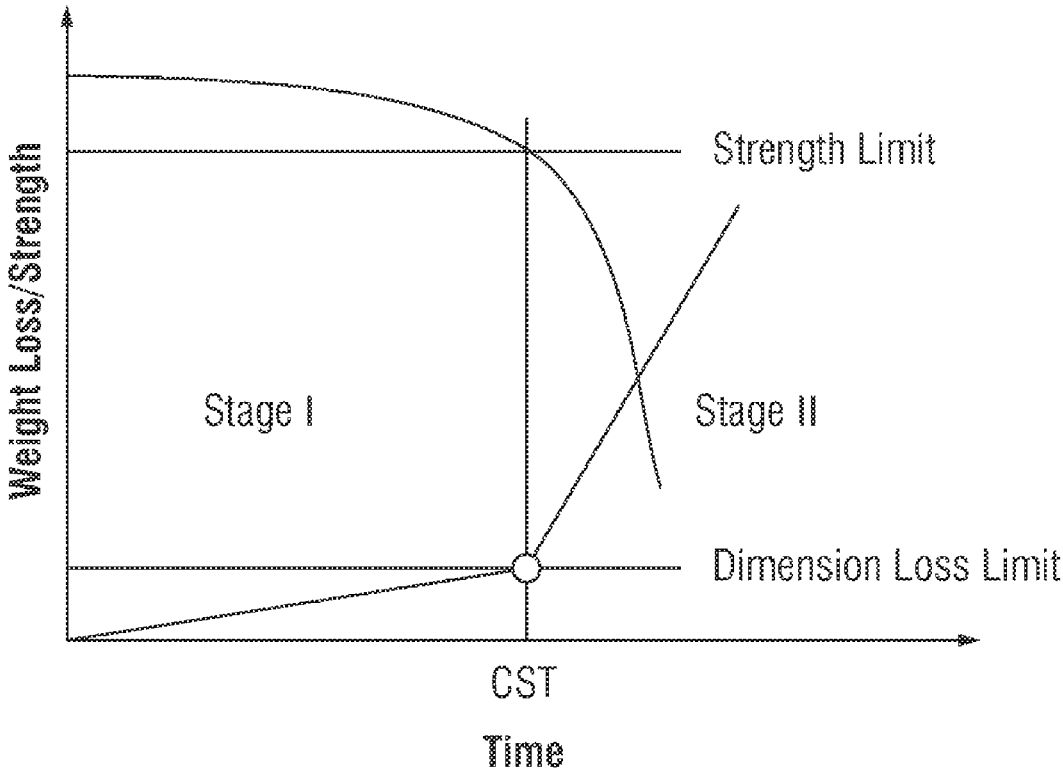
FIG. 8 is a schematic illustration of a change in a property of a powder compact as disclosed herein as a function of time and a change in condition of the powder compact environment.

Powder compacts 400 as disclosed herein may be configured to be selectively and controllably dissolvable in a wellbore fluid in response to a changed condition in a wellbore. Examples of the changed condition that may be exploited to provide selectable and controllable dissolvability include a change in temperature, change in pressure, change in flow rate, change in pH or change in chemical composition of the wellbore fluid, or a combination thereof. An example of a changed condition comprising a change in temperature includes a change in well bore fluid temperature. For example, powder compacts 400 comprising dispersed particles 414 that include Mg and cellular nanomatrix 416 that includes various nanomatrix materials as described herein have relatively low rates of corrosion in a 3% KCl solution at room temperature that range from about 0 to about 11 $mg/cm^2/hr$ as compared to relatively high rates of corrosion at 200° F. that range from about 1 to about 246 $mg/cm^2/hr$ depending on different nanoscale coating layers 216. An example of a changed condition comprising a change in chemical composition includes a change in a chloride ion concentration or pH value, or both, of the wellbore fluid. For example, powder compacts 400 comprising dispersed particles 414 that include Mg and nanomatrix 416 that includes various nanoscale coatings described herein demonstrate corrosion rates in 15% HCl that range from about 4750 $mg/cm^2/hr$ to about 7432 $mg/cm^2/hr$. Thus, selectable and controllable dissolvability in response to a changed condition in the wellbore, namely the change in the wellbore fluid chemical composition from KCl to HCl, may be used to achieve a characteristic response as illustrated graphically in FIG. 8, which illustrates that at a selected predetermined critical service time (CST) a changed condition may be imposed upon powder compact 400 as it is applied in a given application, such as a wellbore environment, that causes a controllable change in a property of powder compact 400 in response to a changed condition in the environment in which it is applied. For example, at a predetermined CST changing a wellbore fluid that is in contact with powder contact 400 from a first fluid (e.g. KCl) that provides a first corrosion rate and an associated weight loss or strength as a function of time to a second wellbore fluid (e.g., HCl) that provides a second corrosion rate and associated weight loss and strength as a function of time, wherein the corrosion rate associated with the first fluid is much less than the corrosion rate associated with the second fluid. This characteristic response to a change in wellbore fluid conditions may be used, for example, to associate the critical service time with a dimension loss limit or a minimum strength needed for a particular application, such that when a wellbore tool or component formed from powder compact 400 as disclosed herein is no longer needed in service in the wellbore (e.g., the CST) the condition in the wellbore (e.g., the chloride ion concentration of the wellbore fluid) may be changed to cause the rapid dissolution of powder compact 400 and its removal from the wellbore. In the example described above, powder compact 400 is selectably dissolvable at a rate that ranges from about 0 to about 7000 $mg/cm^2/hr$. This range of response provides, for example the ability to remove a 3 inch diameter ball formed from this material from a wellbore by altering the wellbore fluid in less than one hour. The selectable and controllable dissolvability behavior described above, coupled with the excellent strength and low density properties described herein, define a new engineered dispersed particle-nanomatrix material that is configured for contact with a fluid and configured to provide a selectable and controllable transition from one of a first strength condition to a second strength condition that is lower than a functional strength threshold, or a first weight loss amount to a second weight loss amount that is greater than a weight loss limit, as a function of time in contact with the fluid. The dispersed particle-nanomatrix composite is characteristic of the powder compacts 400 described herein and includes a cellular nanomatrix 416 of nanomatrix material 420, a plurality of dispersed particles 414 including particle core material 418 that is dispersed within the matrix. Nanomatrix 416 is characterized by a solid-state bond layer 419, which extends throughout the nanomatrix. The time in contact with the fluid described above may include the CST as described above. The CST may include a predetermined time that is desired or required to dissolve a predetermined portion of the powder compact 400 that is in contact with the fluid. The CST may also include a time corresponding to a change in the property of the engineered material or the fluid, or a combination thereof In the case of a change of property of the engineered material, the change may include a change of a temperature of the engineered material. In the case where there is a change in the property of the fluid, the change may include the change in a fluid temperature, pressure, flow rate, chemical composition or pH or a combination thereof Both the engineered material and the change in the property of the engineered material or the fluid, or a combination thereof, may be tailored to provide the desired CST response characteristic, including the rate of change of the particular property (e.g., weight loss, loss of strength) both prior to the CST (e.g., Stage 1) and after the CST (e.g., Stage 2), as illustrated in FIG. 8.

Without being limited by theory, powder compacts 400 are formed from coated powder particles 212 that include a particle core 214 and associated core material 218 as well as a metallic coating layer 216 and an associated metallic coating material 220 to form a substantially-continuous, three-dimensional, cellular nanomatrix 216 that includes a nanomatrix material 420 formed by sintering and the associated diffusion bonding of the respective coating layers 216 that includes a plurality of dispersed particles 414 of the particle core materials 418. This unique structure may include metastable combinations of materials that would be very difficult or impossible to form by solidification from a melt having the same relative amounts of the constituent materials. The coating layers and associated coating materials may be selected to provide selectable and controllable dissolution in a predetermined fluid environment, such as a wellbore environment, where the predetermined fluid may be a commonly used wellbore fluid that is either injected into the wellbore or extracted from the wellbore. As will be further understood from the description herein, controlled dissolution of the nanomatrix exposes the dispersed particles of the core materials. The particle core materials may also be selected to also provide selectable and controllable dissolution in the wellbore fluid. Alternately, they may also be selected to provide a particular mechanical property, such as compressive strength or sheer strength, to the powder compact 400, without necessarily providing selectable and controlled dissolution of the core materials themselves, since selectable and controlled dissolution of the nanomatrix material surrounding these particles will necessarily release them so that they are carried away by the wellbore fluid. The microstructural morphology of the substantially-continuous, cellular nanomatrix 416, which may be selected to provide a strengthening phase material, with dispersed particles 414, which may be selected to provide equiaxed dispersed particles 414, provides these powder compacts with enhanced mechanical properties, including compressive strength and sheer strength, since the resulting morphology of the nanomatrix/dispersed particles can be manipulated to provide strengthening through the processes that are akin to traditional strengthening mechanisms, such as grain size reduction, solution hardening through the use of impurity atoms, precipitation or age hardening and strength/work hardening mechanisms. The nanomatrix/dispersed particle structure tends to limit dislocation movement by virtue of the numerous particle nanomatrix interfaces, as well as interfaces between discrete layers within the nanomatrix material as described herein. This is exemplified in the fracture behavior of these materials. A powder compact 400 made using uncoated pure Mg powder and subjected to a shear stress sufficient to induce failure demonstrated intergranular fracture. In contrast, a powder compact 400 made using powder particles 212 having pure Mg powder particle cores 214 to form dispersed particles 414 and metallic coating layers 216 that includes Al to form nanomatrix 416 and subjected to a shear stress sufficient to induce failure demonstrated transgranular fracture and a substantially higher fracture stress as described herein. Because these materials have high-strength characteristics, the core material and coating material may be selected to utilize low density materials or other low density materials, such as low-density metals, ceramics, glasses or carbon, that otherwise would not provide the necessary strength characteristics for use in the desired applications, including wellbore tools and components.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A method of unplugging a seat, comprising:

dissolving at least a surface defined by a shell surrounding a core of a plug seated against the seat;

unseating the plug from the seat;

dimensioning the core to fit through the seat without dissolving the core; and passing the core through the seat.

2. The method of unplugging a seat of claim 1, wherein the dissolving includes corroding.

3. The method of unplugging a seat of claim 1, wherein the plug is a ball.

4. The method of unplugging a seat of claim 1, wherein the unseating includes unsealing.

5. The method of unplugging a seat of claim 1, wherein the unseating includes dislodging.

6. A plug comprising a body having an outer surface defined by a shell surrounding a core configured to seatingly engage a seat, the shell being configured to dissolve upon exposure to a target environment, the core being dimensioned to allow passage of the core through the seat upon dissolution of the shell without dissolution of the core.

7. The plug of claim 6, wherein dissolution of the shell unseats the plug from the seat.

8. The plug of claim 6, wherein the dissolution occurs at a known rate.

9. The plug of claim 6, wherein the dissolution occurs at a uniform rate.

10. The plug of claim 6, wherein the plug is a ball.

11. The plug of claim 6, wherein the target environment includes wellbore fluid.

12. The plug of claim 6, wherein the target environment includes elevated temperatures.

13. The plug of claim 6, wherein the target environment includes elevated pressures.

14. The plug of claim 6, wherein the plug is supportive of fracturing pressures prior to dissolution of the shell.

15. A plug comprising a body having an outer surface configured to seatingly engage a seat, at least the outer surface of the body being configured to dissolve upon exposure to a target environment at least the outer surface of the body being made of a powder metal compact, comprising:

a substantially-continuous, cellular nanomatrix comprising a nanomatrix material;

a plurality of dispersed particles comprising a particle core material that comprises Mg, Al, Zn or Mn, or a combination thereof, dispersed in the cellular nanomatrix; and a solid-state bond layer extending throughout the cellular nanomatrix between the dispersed particles.

16. The plug of claim 15, wherein the dispersed particles comprise Mg—Zn, Mg—Zn, Mg—Al, Mg—Mn, Mg—Zn—Y, Mg—Al—Si or Mg—Al—Zn.

17. The plug of claim 15, wherein the dispersed particles have an average particle size of about 5 μm to about 300 μm.

18. The plug of claim 15, wherein the dispersed particles have an equiaxed particle shape.

19. The plug of claim 15, wherein the nanomatrix material comprises Al, Zn, Mn, Mg, Mo, W, Cu, Fe, Si, Ca, Co, Ta, Re or Ni, or an oxide, carbide or nitride thereof, or a combination of any of the aforementioned materials, and wherein the nanomatrix material has a chemical composition and the particle core material has a chemical composition that is different than the chemical composition of the nanomatrix material.

20. The plug of claim 15, wherein the cellular nanomatrix has an average thickness of about 50 nm to about 5000 nm.

* * * * *